US008694308B2

(12) United States Patent
Arakawa et al.

(10) Patent No.: US 8,694,308 B2
(45) Date of Patent: Apr. 8, 2014

(54) SYSTEM, METHOD AND PROGRAM FOR VOICE DETECTION

(75) Inventors: Takayuki Arakawa, Tokyo (JP); Masanori Tsujikawa, Tokyo (JP)

(73) Assignee: Nec Corporation, Tokyo (JP)

( * ) Notice: Subject to any disclaimer, the term of this patent is extended or adjusted under 35 U.S.C. 154(b) by 839 days.

(21) Appl. No.: 12/744,671

(22) PCT Filed: Nov. 26, 2008

(86) PCT No.: PCT/JP2008/071459
§ 371 (c)(1),
(2), (4) Date: May 25, 2010

(87) PCT Pub. No.: WO2009/069662
PCT Pub. Date: Jun. 4, 2009

(65) Prior Publication Data

US 2010/0268532 A1 Oct. 21, 2010

(30) Foreign Application Priority Data

Nov. 27, 2007 (JP) ..... 2007-305966

(51) Int. Cl.
*G10L 11/06* (2006.01)

(52) U.S. Cl.
USPC ..... 704/214

(58) Field of Classification Search
USPC ..... 704/208–215
See application file for complete search history.

(56) References Cited

U.S. PATENT DOCUMENTS 3,349,180 A * 10/1967 Coker ..... 704/214
3,420,955 A * 1/1969 Noll ..... 704/208

(Continued)

FOREIGN PATENT DOCUMENTS

JP 10-207491 A 8/1998
JP 2006209069 A 8/2006

(Continued)

OTHER PUBLICATIONS

International Search Report for PCT/JP2006/071459 mailed Jan. 6, 2009.

(Continued)

*Primary Examiner* — Abul Azad
(74) *Attorney, Agent, or Firm* — Sughrue Mion, PLLC

(57) ABSTRACT

A system for voice detection includes a feature value calculation unit that calculates a feature value from an input signal sliced on a per frame basis, a provisional voice/non-voice decision unit that provisionally decides a voiced interval and a non-voiced interval from the feature value calculated on a per frame basis, and a voice/non-voice decision unit that determines a voiced interval duration threshold value or a non-voiced interval duration threshold value, using a ratio of the feature value found on a per frame basis to a threshold value for the feature value and that re-decides the voiced interval and the non-voiced interval, using the voiced interval duration threshold value determined and the non-voiced interval duration threshold value determined. By determining the voiced interval duration threshold value and the non-voiced interval duration threshold value, using the feature value found on a per frame basis and the threshold value for the feature value, the constraint of the shaping rule may be made weaker, or stronger in case the feature value found on a per frame basis can be regarded as being reliable or not, thereby allowing voice detection to be made without dependency upon a noise environment.

36 Claims, 10 Drawing Sheets

(56) References Cited

U.S. PATENT DOCUMENTS

| | | | | | |
|---|---|---|---|---|---|
| 3,916,105 | A | * | 10/1975 | McCray | 704/219 |
| 4,509,186 | A | * | 4/1985 | Omura et al. | 704/231 |
| 4,589,131 | A | * | 5/1986 | Horvath et al. | 704/214 |
| 5,197,113 | A | * | 3/1993 | Mumolo | 704/200 |
| 5,664,052 | A | * | 9/1997 | Nishiguchi et al. | 704/214 |
| 6,490,554 | B2 | * | 12/2002 | Endo et al. | 704/215 |
| 8,036,884 | B2 | * | 10/2011 | Lam et al. | 704/205 |
| 8,175,868 | B2 | * | 5/2012 | Terao | 704/214 |

FOREIGN PATENT DOCUMENTS

| | | | |
|---|---|---|---|
| JP | 2008-134565 | A | 6/2008 |
| JP | 2008151840 | A | 7/2008 |
| WO | 0139175 | A | 5/2001 |

OTHER PUBLICATIONS

ETSI EN 301 708 V7.1.1, Section 4, "Technical Description of VAD Option 2", Dec. 1999, pp. 17-26.

ITU-T Recommendation G.729—Annex B, Section B.3.1-B.3.1.4, Nov. 1999, p. 4.

A. Lee et al., "Noise Robust Real World Spoken Dialogue System using GMM Based Rejection of Unintended Inputs", ICSLP-2004, vol. 1, Oct. 2004, pp. 173-176.

Y. Kida et al., "Voice Activity Detection based on Optimally Weighted Combination of Multiple Features",IPSJ SIG Technical Report, 2005-SLP-57(9), Jul. 15, 2005, pp. 49-54.

K. Kita, "Stochastic Language Model", chapter 6, pp. 155-162, 1999, University of Tokyo Press.

Japanese Office Action for JP Application No. 2009-543830 mailed on Sep. 3, 2013 with Partial English Translation.

* cited by examiner

SYSTEM, METHOD AND PROGRAM FOR VOICE DETECTION

This application is the National Phase of PCT/JP2008/071459, filed on Nov. 26, 2008, which is based upon and claims the benefit of the priority of Japanese patent application No. 2007-305966 filed on Nov. 27, 2007, the disclosure of which is incorporated herein in its entirety by reference thereto.

TECHNICAL FIELD

This invention relates to a technique for voice detection. More particularly, it relates to a system, a method and a program for determining an input signal to be a voiced interval or a non-voiced interval.

BACKGROUND ART

The technique of voice detection that determines an input signal into a voiced interval and a non-voiced interval has been in wide spread used in a variety of technical fields. Several examples are given below.

For example, in mobile communications, voice detection is used to improve the voice transmit efficiency, e.g., to improve compression efficiency for a non-voiced interval, or not to transmit a non-voiced interval.

In a noise canceller or an echo canceller, voice detection is used to estimate or determine a noise between non-voiced intervals.

Further, in a voice recognition system, voice detection is used to improve performance, or reduce processing amount.

FIG. 10 illustrates a configuration of a typical voice detection apparatus (related technique). As regards this sort of the voice detection apparatus, reference may be made to, for example, the disclosure of Patent Document 1.

Referring to FIG. 10, this voice detection apparatus includes an input signal acquisition unit 1 that slices the input signal on a per frame basis and acquires the so sliced frame-based input signal, a feature value calculation unit 2 that calculates a feature value, used for voice detection, from the sliced frame-based input signal, voice/non-voice decision unit 14 that compares a feature value with its threshold value stored in a threshold value storage unit 13, on a per frame basis, to distinguish between voice and non-voice, and an interval shaping unit 16 that performs shaping of a decision result, which has been found on a per frame basis across a plurality of frames, based on a shaping rule stored in a shaping rule storage unit 15, to determine the voiced interval and the non-voiced interval.

A large variety of feature values, calculated by the feature value calculation unit 2, are used for voice detection. An example of the feature value is a smoothed version of variations of the spectral power (see Patent Document 1). Other examples of the feature value may include a value of SNR (signal-to-noise ratio) (see Non-Patent Document 1 (paragraph 4.3.3)), a mean value of SNR (see Non-Patent Document 1 (paragraph 4.3.5)), a zero-crossing number (see Non-Patent Document 2 (paragraph B.3.1.4)), a likelihood ratio that uses a voice GMM (Gaussian Mixture Model) and a silent GMM (see Non-Patent Document 3), and a combination of a plurality of feature values (see Non-Patent Document 4).

The interval shaping unit 16 performs interval shaping in order to suppress coming out of voiced intervals or non-voiced intervals of shorter durations that may be produced in case the voice/non-voice decision unit 14 performs voice/non-voice decision on a per frame basis.

As a shaping rule, used for determining a voiced interval/non-voiced interval, Patent Document 1 has disclosed the following.

Condition (1): a voiced interval that has failed to satisfy the necessary minimum duration is not recognized as the voiced interval. In the following description, this necessary minimum duration is termed 'voiced interval duration threshold value'.

Condition (2): a non-voiced interval that is sandwiched between voiced intervals and that satisfies the duration to be treated as a continuous voiced interval is combined with the both end voiced intervals, and the resulting interval is treated as a single voiced interval. In the present description, the duration to be treated as a continuous voiced interval is termed a 'non-voiced interval duration threshold value' because an interval greater than or equal to this duration is decided to be a non-voiced interval.

Condition (3): A pre-defined constant number of frames are appended to leading and trailing ends of a voiced interval. In the present description, the constant number of frames, appended to the leading and trailing ends of the voiced interval, are respectively termed 'leading and trailing end margins'.

In the present voice detection apparatus, preset values are used for the threshold values for the feature values, found on a per frame basis and for parameters relating to the shaping rule.

Patent Document 1:

JP Patent Kokai Publication No. JP-P2006-209069A

Non-Patent Document 1:

ETSI EN 301 708 V7.1.1

Non-Patent Document 2:

ITU-T G.729 Annex B

Non-Patent Document 3:

A. Lee, K. Nakamura, R. Nishimura, H. Saruwatari, K. Shikano, 'Noise Robust Real World Spoken Dialogue System using GMM Based Rejection of Unintended Inputs, "ICSLP-2004, Vol. 1, pp. 173-176, October 2004

Non-Patent Document 4:

Yusuke Kida and Tatsuya Kawahara, "Voice Activity Detection based on Optimally Weighted Combination of Multiple Features", IPSJ SIG Technical Report, 2005-SLP-57(9)

Non-Patent Document 5:

Kenji Kita, 'Stochastic Language Model', chapter 6, pp. 155-162, 1999, University of Tokyo Press

SUMMARY

The disclosures of the Patent Document 1 and the Non-Patent Documents 1 to 5 are incorporated herein by reference. The following analysis is made by the present invention.

In the system discussed above with reference to FIG. 10, there is a case where a threshold value for a feature value or a parameter relating to a shaping rule may undergo a significant deviation depending on a noise environment.

For example, in case the noise environment is unknown or the noise environment undergoes variations, it is not possible to preset a threshold value for a feature value or a parameter relating to a shaping rule to optimum a value at the outset. The performance achieved may thus not be so sufficient as expected.

It is therefore an object of the present invention to provide a voice detection system, a method and a voice detection program whereby high performance voice detection may be achieved without dependency upon a noise environment.

The invention may be summarized substantially, though not limited thereto, as follows:

According to an aspect of the present invention, there is provided a voice detection apparatus comprising:

a means that provisionally decides an input signal to be voiced or non-voiced on a per frame basis;

a means that performs interval shaping of the voiced and non-voiced sequences of the provisional decision result, in accordance with a rule for a pre-defined number of frames, to find a voiced interval and a non-voiced interval of the input signal; and a means that variably controls, on a per frame basis, one or more parameters of the rule regarding the interval shaping, based on whether or not a feature value of the frame of the input signal can be regarded as being reliable.

According to the present invention, there is also provided a voice detection apparatus comprising:

a provisional voice/non-voice decision unit that provisionally decides an input signal to be voiced or non-voiced on a per frame basis;

a voice/non-voice decision unit that performs interval shaping on the voiced and non-voiced sequences of the provisional decision result, based on at least one of a voiced interval duration threshold value, which is a threshold value of a voiced interval duration used for deciding whether or not a frame of interest is in a voiced interval; and a non-voiced interval duration threshold value, which is a threshold value of a non-voiced interval duration used for deciding whether or not a frame of interest is in a non-voiced interval to find the voiced interval and the non-voiced interval of the input signal; and a threshold duration determination unit that determines at least one of the threshold value for the voiced interval duration and the threshold value for the non-voiced interval duration, on a per frame basis, based on at least one of a provisional threshold value of a voiced interval duration and a provisional threshold value of a non-voiced interval duration;

at least one feature value of the input signal found for the frame of interest; and a threshold value for the feature value.

According to the present invention, there is provided a method for voice detection, comprising:

a step of provisionally deciding an input signal to be the voiced or the non-voiced on a per frame basis;

a step of performing interval shaping of the voiced and non-voiced sequences of the provisional decision result, in accordance with a rule for a pre-defined number of frames, to find a voiced interval and a non-voiced interval of the input signal; and a step of varying, on a per frame basis a parameter of the rule regarding the interval shaping, depending on whether or not the feature value of the frame of the input signal can be regarded as being reliable.

According to the present invention, there is provided a method for voice detection, comprising:

a step of provisionally deciding an input signal into voice or non-voice on a per frame basis;

a step of performing interval shaping on the voiced and non-voiced sequences of the provisional decision result, based on at least one of a voiced interval duration threshold value, which is a threshold value of a voiced interval duration used for deciding whether or not a frame of interest is in a voiced interval;

a non-voiced interval duration threshold value, which is a threshold value of a non-voiced interval duration used for deciding whether or not a frame of interest is in a non-voiced interval to find the voiced interval and the non-voiced interval of the input signal; and a step of determining at least one of the voiced interval duration threshold value and the non-voiced interval duration threshold value, on a per frame basis, based on at least one of a provisional threshold value of the voiced interval duration and a provisional threshold value of the non-voiced interval duration;

at least one feature value of the input signal found for the frame of interest; and a threshold value for the feature value.

According to the present invention, there is provided a program that causes a computer to execute:

a processing that provisionally decides an input signal to be the voiced or the non-voiced on a per frame basis;

a processing that finds a voiced interval and a non-voiced interval of the input signal by interval shaping of the voiced and non-voiced sequences of the provisional decision result, in accordance with a rule for a pre-defined number of frames; and the processing of varying, on a per frame basis a parameter of the rule regarding the interval shaping, depending on whether or not the feature value of the frame of the input signal can be regarded as being reliable. According to the present invention, there is also provided a computer-readable recording medium storing the above program according to the present invention.

According to the present invention, in which a shaping rule is determined in accordance with whether or not a feature found on a per frame basis can be regarded as being reliable, the high performance voice detection with no dependency upon a noise environment may be achieved.

Still other features and advantages of the present invention will become readily apparent to those skilled in this art from the following detailed description in conjunction with the accompanying drawings wherein only exemplary embodiments of the invention are shown and described, simply by way of illustration of the best mode contemplated of carrying out this invention. As will be realized, the invention is capable of other and different embodiments, and its several details are capable of modifications in various obvious respects, all without departing from the invention. Accordingly, the drawing and description are to be regarded as illustrative in nature, and not as restrictive.

PREFERRED MODES

For further detailed description of the present invention, exemplary embodiments of the present invention will be hereinafter explained with reference to the drawings. Initially, one of operating principles of the present invention will be described.

According to the present invention, a feature value is calculated from an input signal sliced out on a per frame basis. The voiced interval and the non-voiced interval are provisionally decided from the feature value calculated on a per frame basis. A voiced interval duration threshold value or a non-voiced interval duration threshold value is determined using a ratio of a feature value that has been found on a per frame basis to a threshold value for the feature value. The voiced interval duration threshold value and non-voiced interval duration threshold value, thus determined, are then used to re-decide the voice and non-voiced intervals. According to the present invention, the binding or effect of the shaping rule is lessened n case the feature value found on a per frame basis can be regarded as being reliable, while the binding or effect of the shaping rule is increased in case the feature value found on a per frame basis can be regarded as being not reliable. By so doing, weights for a feature value found on a per frame basis and for the shaping rule may be determined in accordance with the noise environment. It is thus possible to achieve optimum or closely optimum high performance voice detection with no dependency upon a noise environment. The present invention will now be described with reference to exemplary embodiments.

Exemplary Embodiment 1

Figure 1:
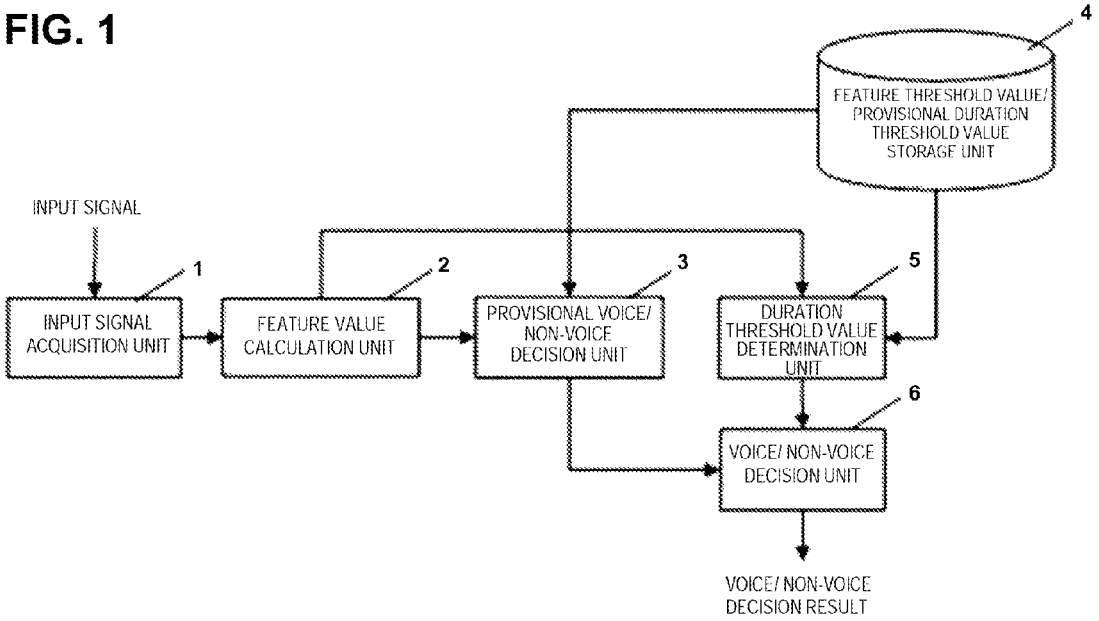
FIG. 1 is a block diagram showing a configuration of first and second exemplary embodiments of the present invention.

FIG. 1 illustrates a configuration of a first exemplary embodiment of the present invention. Referring to FIG. 1, the first exemplary embodiment of the present invention includes an input signal acquisition unit 1 that slices an input signal into a plurality of frames as units to acquire the resulting frame-based input signal, a feature value calculation unit 2 that calculates feature values from the input signal sliced in terms of frames as units, a provisional voice-non-voice decision unit 3 that provisionally decides the voice/non-voice, on a per frame basis, from the feature values calculated on a per frame basis, a feature threshold value/provisional duration threshold value storage unit 4 in which a threshold value for feature values found on a per frame basis a threshold value for a provisional voiced interval duration, and a threshold value for a provisional non-voice duration, are stored, a duration threshold value determination unit 5 that determines a duration threshold value from the feature values and from the threshold value for the feature values as well as the provisional duration threshold value stored in the feature threshold value/provisional duration threshold value storage unit 4, and a voice/non-voice decision unit 6 that again determines the voice/non-voice, on a per frame basis, from the results of the provisional voice/non-voice decision and from the duration threshold value as determined. It is noted that the functions or processing operations of the above mentioned units may be implemented by a program that is executed on a computer that composes the voice detection system. The same may apply for other exemplary embodiments which will now be described hereinbelow.

Figure 2:
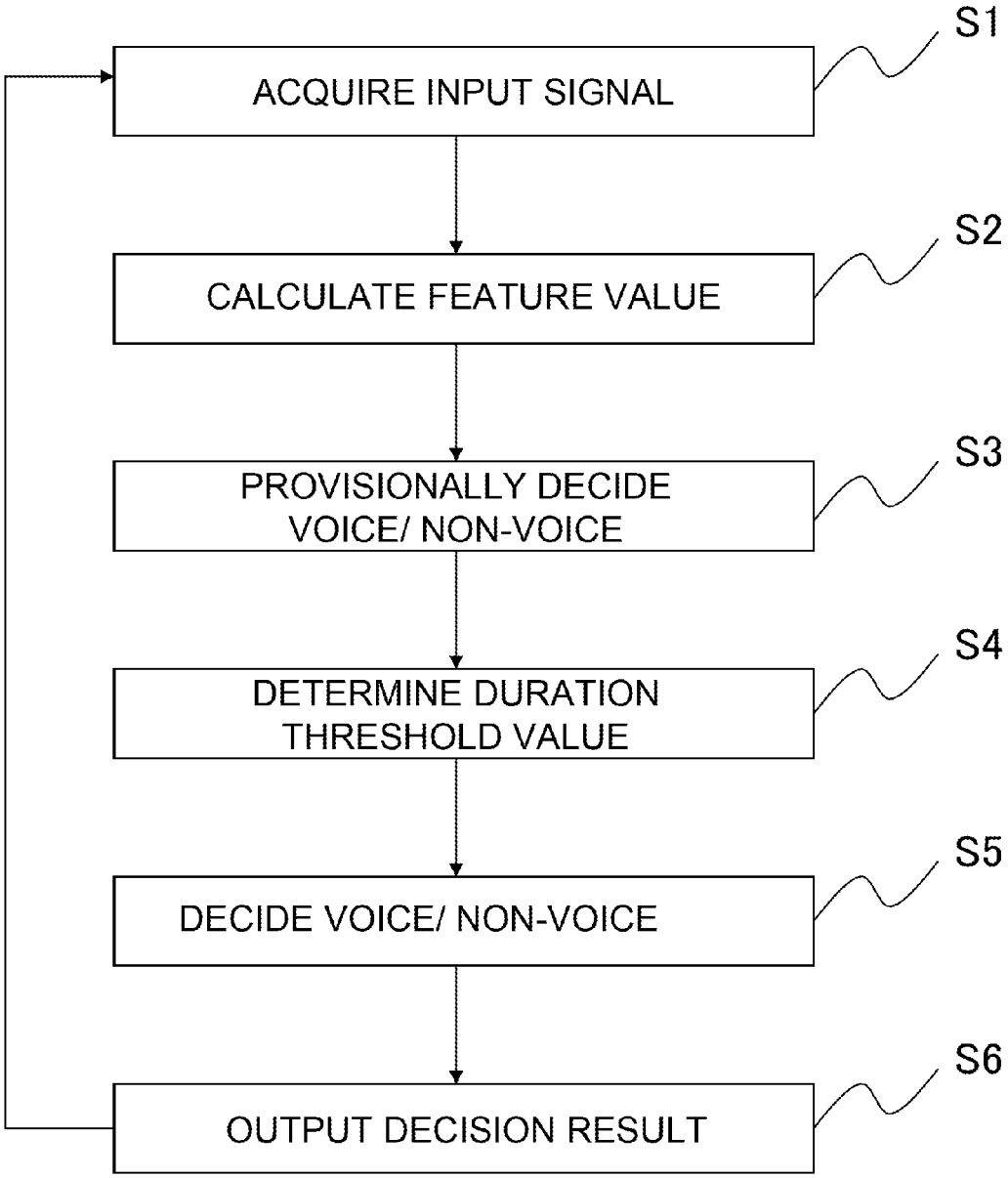
FIG. 2 is a flowchart for illustrating the processing sequence of the exemplary embodiments of the present invention.

FIG. 2 is a flowchart that illustrates the operation (processing sequence) of the first exemplary embodiment of the present invention. The global operation of the present exemplary embodiment will now be described in detail with reference to FIGS. 1 and 2.

Initially, the input signal acquisition unit 1 sets a window to an input signal, acquired by e.g. a microphone apparatus, on a per frame basis, to slice out the input signal (step S1).

The input signal, obtained in the time domain, may be sliced out with a window width of 200 ms, as frame unit, as the signal is shifted by 50 ms each time, only by way of illustration.

In the subsequent operation of the present exemplary embodiment, a single frame may be processed in accordance with steps S1 to S6 and the second and following frames may then be repetitively processed in similar manner. Or, a plurality of frames may collectively be processed in each of the above steps.

The feature value calculation unit 2 then calculates a feature value, used in voice detection, from the input signal sliced out on a per frame basis(step S2).

As the feature value calculated, for example, the following may be used.

SNR, zero point crossing, ratio of a voice likelihood to a non-voice likelihood, a first derivative or a second derivative of a voice power, and a smoothed version of a feature value.

The feature value for a frame t is denoted as F(t).

The provisional voice/non-voice decision unit 3 sequentially performs decision on a per frame basis, whether a given frame is voiced or non-voiced. The voice/non-voice decision is given on the basis of whether the feature is of a magnitude not less than a threshold value stored in the feature threshold value/provisional duration threshold value storage unit 4.

The following relationship (1) shows a case where it is expected that the feature value is greater than its threshold value in the voiced interval and smaller than its threshold value in the non-voiced interval. There may be cases where the relative magnitude is inverted in the voiced interval and in the non-voiced interval. In such cases, the feature and threshold values may be multiplied by −1, whereby the decision may be made in the similar manner to that described above.

$$F(t) \geq \theta_F \text{ voiced} \quad (1)$$

$$F(t) < \theta_F \text{ non-voiced} \quad (2)$$

In the above relationships (1) and (2), $\theta_F$ denotes a threshold value of a feature.

The duration threshold value determination unit 5 then determines a duration threshold value from the feature value found on a per frame basis and from the threshold value for the feature value, and from the provisional duration threshold value. The threshold value for the feature value and the provisional duration threshold value are stored in the feature threshold value/provisional duration threshold value storage unit 4 (step S4). Specifically, the duration of the voiced interval is calculated using the following equation (3) or (4).

$$L_{V_thres}[t] = \theta_V + \frac{\lambda_F}{\lambda_V}(\theta_F - F[t]) \tag{3}$$

$$L_{V_thres}[t] = \left(\frac{\theta_F}{F(t)}\right)^{\lambda_F/\lambda_V}\theta_V \tag{4}$$

In the equations (3) and (4), $L_{V_thres}$ denotes an determined voiced interval duration (threshold value).

$\theta_V$ denotes a provisional voiced interval duration threshold value. $\theta_F$ denotes a threshold value for the feature value. The value of $\theta_F$ may be the same as or different from that of the inequality (1) or (2). The feature value may be different from that of the inequality (1) or (2).

$\lambda_F$ and $\lambda_V$ denote pre-set weights used in determining on which of the feature value and the provisional voiced interval duration threshold value emphasis is to be put in finding the determined voiced interval duration threshold value.

In the present exemplary embodiment, in which the determined voiced interval duration threshold value is calculated using the equation (3) or (4), the constraint (influence or contribution) of the provisional voiced interval duration threshold value may be varied in dependence upon whether or not the frame-based voice/non-voice decision can be regarded reliable.

Figure 3:
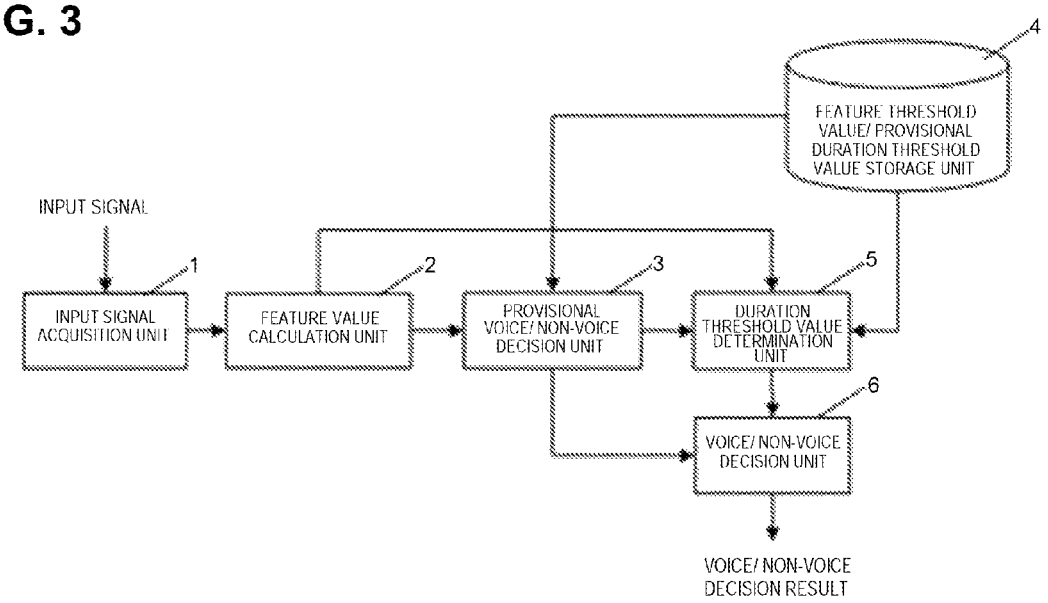
FIG. 3 is a block diagram showing a configuration of a third exemplary embodiment of the present invention.

This will now be explained with reference to FIG. 3, for example. In a less noisy environment, the feature value is sufficiently greater than its threshold value, in a voiced interval, so that the determined voiced interval duration (length) threshold value $L_{V_thres}$ becomes smaller than the provisional voiced interval duration threshold value $\theta_V$. In a non-voiced interval, the feature value is sufficiently smaller than its threshold value, so that the determined voiced interval duration (length) threshold value $L_{V_thres}$ becomes greater than the provisional voiced interval duration threshold value $\theta_V$. The determined voiced interval duration threshold value is thus determined depending solely on whether or not the feature value F(t) exceeds the threshold value of $\theta_F$. Hence, the constraint (influence or contribution) of the provisional voiced interval duration threshold value $\theta_V$ in the determined voiced interval duration (length) threshold value $L_{V_thres}$ becomes greater.

On the other hand, in a noisy environment, the difference of the feature value F(t) and its threshold value during the voiced interval and that during the non-voiced interval are decreased. Hence, the second term of the right side of the equation (3) is of a small magnitude. The determined voiced interval duration threshold value $L_{V_thres}$ is thus determined substantially only by the provisional voiced interval duration threshold value $\theta_V$. Hence, the constraint (influence or contribution) by the provisional voiced interval duration threshold value $\theta_V$ on the determined voiced interval duration threshold value $L_{V_thres}$ increases.

The non-voiced interval duration threshold value is determined using the equations (5) and (6):

$$L_{N_thres}[t] = \theta_N + \frac{\lambda_F}{\lambda_N}(F[t] - \theta_F) \tag{5}$$

$$L_{N_thres}[t] = \left(\frac{F[t]}{\theta_F}\right)^{\lambda_F/\lambda_N}\theta_N \tag{6}$$

Meanwhile, in the equations (5) and (6), $L_{N_thres}$ denotes an determined non-voiced interval duration threshold value and $\theta_N$ denotes a provisional non-voiced interval duration threshold value.

$\lambda_F$ and $\lambda_N$ are pre-set weights used in determining on which of the feature value and the provisional non-voiced interval duration threshold value emphasis is to be put in finding the determined non-voiced interval duration threshold value.

By calculating the determined non-voiced interval duration threshold value, using the equations (5) and (6), the constraint or binding of the provisional non-voiced interval duration threshold value may be varied depending on whether or not the frame-based voice/non-voice decision can be regarded reliable, as in the equations (3) and (4).

Turning again to FIG. 2, the voice/non-voice decision unit 6 again sequentially determines the voice and the non-voice, on a per frame basis, using the decision result on the voice/non-voice, voiced interval duration threshold value determined, and on the non-voiced interval duration threshold value determined (step S5).

In more detail, if in case the frame of interest has been determined by the provisional voice/non-voice decision unit 3 to belong to the voiced interval, the duration $L_V(t)$ of the voiced interval before and at back of the frame of interest, inclusive of the frame of interest, has the duration $L_V(t)$ not less than the determined voiced interval duration threshold value, as indicated by the relationship (7), the frame of interest is decided to be voiced. If the duration $L_V(t)$ of the voiced interval is less than the determined voiced interval duration threshold value, the frame of interest is decided to be non-voiced.

$$L_V(t) \geq L_{V_thres}(t) \text{ voiced}$$

$$L_V(t) < L_{V_thres}(t) \text{ non-voiced} \tag{7}$$

On the other hand, if, in case the frame of interest has been determined by the provisional voice/non-voice decision unit 3 to belong to a non-voiced interval, the duration $L_N(t)$ of the voiced interval before and at back of the frame of interest, inclusive of the frame of interest, has the duration $L_N(t)$ not higher than the determined non-voiced interval duration threshold value, as indicated by the relationship (8), the frame of interest is decided to be voiced. If the duration $L_N(t)$ of the voiced interval is longer than the determined voiced interval duration threshold value, the frame of interest is decided to be non-voiced.

$$L_N(t) \leq L_{N_thres}(t) \text{ voiced}$$

$$L_N(t) > L_{N_thres}(t) \text{ non-voiced} \tag{8}$$

If desired to find the duration of the voiced interval or the non-voiced interval contiguous to the leading and trailing ends of a frame of interest, inclusive of the frame of interest, it is necessary that a future frame has already been determined by the provisional voice/non-voice decision unit 3. Hence, calculations of the duration of the voiced interval or the non-voiced interval, contiguous to the leading and trailing ends of the frame of interest, inclusive of the frame of interest, cannot be made until the decision is given on the frame needed for the calculations. It is thus necessary to delay the processing for the calculations in comparison with the processing by the provisional voice/non-voice decision unit 3.

Finally, the voice/non-voice results are output (step S6).

In this step S6, outputting the decision result on the voice/non-voice, it is possible to append margin intervals to the beginning and the trailing ends of the voiced interval, found until the step S5, before outputting the decision result.

In outputting decision result on the voice/non-voice, a message indicating that the voiced interval is initiated or a message indicating that the voiced interval has come to a close may be output on a display, as a file, or in a data stream being transmitted. Or, labels such as label 1 for a voiced interval or label 0 for a non-voiced interval may be output in a chronological sequence.

The processing described above may be used as a pre-stage processing. That is, the decision result on the voice/non-voice output may be used for

- estimating a noise in a non-voiced interval,
- compressing transmitted data in the non-voiced interval, or
- doing the processing for voice recognition only during the voiced interval.

The operation and meritorious effects of the present exemplary embodiment will now be described. If, in the present exemplary embodiment, the frame-based voice/non-voice decision can be regarded reliable with the use of the determined duration threshold values of the relationships (3) to (6), the constraint or binding (influence) by the provisional duration threshold value may be decreased. If conversely the frame-based voice/non-voice decision is not reliable, the constraint or binding (influence) by the provisional duration threshold value may be increased.

It is thus possible to determine the weighting of the shaping rule and the feature value found on a per frame basis in accordance with a noise environment to provide for voice detection of high performance with an optimum parameter without dependency upon the noise environment.

Exemplary Embodiment 2

A second exemplary embodiment of the present invention will now be described. The configuration of the second exemplary embodiment of the present invention is similar to that of the first exemplary embodiment shown in FIG. 1.

In the present exemplary embodiment, the ratio or difference values of a plurality of feature values and the threshold values for the feature values, found by the duration threshold value determination unit 5 of FIG. 1, are weighted and added together, or weighted and multiplied together.

In more detail, if three sorts of feature values $F_1(t)$, $F_2(t)$ and $F_3(t)$ are used, the equation for calculations of the duration of the voiced interval after the determination of the equation (3) is modified as indicated by the equation (9) or the equation (10):

$$L_{V_thres}(t) = \theta_V + \frac{\lambda_{F_1}}{\lambda_V}(\theta_{F_1} - F_1(t)) + \frac{\lambda_{F_2}}{\lambda_V}(\theta_{F_2} - F_2(t)) + \frac{\lambda_{F_3}}{\lambda_V}(\theta_{F_3} - F_3(t)) \tag{9}$$

$$L_{V_thres}(t) = \left(\frac{\theta_{F_1}}{F_1(t)}\right)^{\lambda_{F_1}/\lambda_V}\left(\frac{\theta_{F_2}}{F_2(t)}\right)^{\lambda_{F_2}/\lambda_V}\left(\frac{\theta_{F_3}}{F_3(t)}\right)^{\lambda_{F_3}/\lambda_V}\theta_V \tag{10}$$

In the equations (9) and (10), $\theta_{F1}$, $\theta_{F2}$ and $\theta_{F3}$ respectively denote threshold values for the feature values 1, 2 and 3 stored in the feature threshold value/provisional duration threshold value storage unit 4.

$\lambda_{F1}$, $\lambda_{F2}$ and $\lambda_{F3}$ respectively denote preset weights for the feature values 1, 2 and 3.

On the other hand, the equation for calculating the non-voiced interval duration after determination of the equation (5) is modified as indicated by the following equation (11) or (12):

$$L_{N_thres}(t) = \theta_N + \frac{\lambda_{F_1}}{\lambda_N}(F_1(t) - \theta_{F_3}) + \frac{\lambda_{F_2}}{\lambda_N}(F_2(t) - \theta_{F_2}) + \frac{\lambda_{F_3}}{\lambda_N}(F_3(t) - \theta_{F_3}) \tag{11}$$

$$L_{N_thres}(t) = \left(\frac{F_1(t)}{\theta_{F_1}}\right)^{\lambda_{F_1}/\lambda_N}\left(\frac{F_2(t)}{\theta_{F_2}}\right)^{\lambda_{F_2}/\lambda_N}\left(\frac{F_3(t)}{\theta_{F_3}}\right)^{\lambda_{F_3}/\lambda_N}\theta_N \tag{12}$$

In the present exemplary embodiment, in which a plurality of feature values are used, it is possible to distinguish between the voice and the non-voice as emphasis is put on a more reliable feature value or values. It is thus possible to achieve voice detection that is more robust against the noisy environment than with the first exemplary embodiment described above.

Exemplary Embodiment 3

A third exemplary embodiment of the present invention will now be described. FIG. 3 shows a configuration of the third exemplary embodiment of the present invention. Referring to FIG. 3, the present exemplary embodiment differs from the first exemplary embodiment as to the processing in the duration threshold value determination unit 5.

In the present exemplary embodiment, the duration threshold value determination unit 5 determines the duration threshold value from the decision result in the provisional voice/non-voice decision unit 3, the feature value calculated by the feature value calculation unit 2, and from the threshold value for the feature value as well as the provisional duration threshold value. The threshold value for the feature value as well as the provisional duration threshold value is stored in the feature threshold value/provisional duration threshold value storage unit 4.

The voiced interval duration threshold value is determined using the ratio of the duration of the non-voiced interval neighboring to the frame of interest, as determined by the provisional voice/non-voice decision unit 3, and the provisional non-voiced interval duration threshold value, in addition to using the provisional voiced interval duration threshold value and the ratio of the feature value found for the frame of interest to the threshold value for the feature value.

The non-voiced interval duration threshold value is determined using the ratio of the duration of the voiced interval neighboring to the frame of interest, as determined by the provisional voice/non-voice decision unit 3, and the provisional voiced interval duration threshold value, in addition to using the provisional non-voiced interval duration threshold value and the ratio of the feature value found for the frame of interest to the threshold value for the feature value.

The voiced interval duration or the non-voiced interval duration may also be determined based on weighted ratio values or weighted difference values of a plurality of feature values, found on a per frame basis and the threshold values for the feature values. The weighted ratio values may be multiplied by one another, while the weighted difference values may be added to one another.

Specifically, the equation for calculating the determined voiced interval duration threshold value, shown in the equation (3), is modified as indicated by the equation (13) or (14).

$$L_{V_thres}(t) = \theta_V + \frac{\lambda_F}{\lambda_V}(\theta_F - F(t)) + \frac{\lambda_N}{\lambda_V}(L_N - \theta_N) \tag{13}$$

$$L_{V_thres}(t) = \left(\frac{\theta_F}{F(t)}\right)^{\lambda_F/\lambda_V}\left(\frac{L_N}{\theta_N}\right)^{\lambda_N/\lambda_V}\theta_V \tag{14}$$

In the above equations (13) and (14), $L_N$ denotes the duration (length) of a non-voiced interval neighboring to a frame which is of interest for the provisional voice/non-voice decision unit, inclusive of the frame of interest, when it is assumed that the frame of interest is a non-voiced frame.

$\lambda_F$, $\lambda_V$ and $\lambda_N$ denote preset weights used in determining on which of the ratio of the feature value to the threshold value for the feature value, the ratio of the voiced interval duration to the provisional voiced interval duration threshold value and the ratio of the non-voiced interval duration to the non-voiced interval duration threshold value to put emphasis in order to find the determined voiced interval duration threshold value.

The equation (5) for calculating the determined non-voiced interval duration threshold value is modified as indicated in equation (15) or (16).

$$L_{N_thres}(t) = \theta_N + \frac{\lambda_F}{\lambda_N}(\theta_F - F(t)) + \frac{\lambda_V}{\lambda_N}(L_V - \theta_V) \tag{15}$$

$$L_{N_thres}(t) = \left(\frac{F(t)}{\theta_F}\right)^{\lambda_F/\lambda_N}\left(\frac{L_V}{\theta_V}\right)^{\lambda_V/\lambda_N}\theta_N \tag{16}$$

In the equations (15) and (16), $L_V$ denotes the duration of a voiced interval neighboring to a frame which is of interest for the provisional voice/non-voice decision unit, inclusive of the voice of interest, in case the frame of interest is assumed to be the voice.

In the present exemplary embodiment, the determined voiced interval duration and the determined non-voiced interval duration are found, using the provisional voiced interval duration and the non-voiced interval duration, in addition to using the feature values found on a per frame basis. By so doing, the voice and the non-voice may be distinguished from each other as more emphasis is put on the provisional voiced interval duration or on the non-voiced interval duration, whichever is more reliable. It is thus possible to detect the voice in a manner more robust against the noisy environment than with the first exemplary embodiment.

Exemplary Embodiment 4

Figure 4:
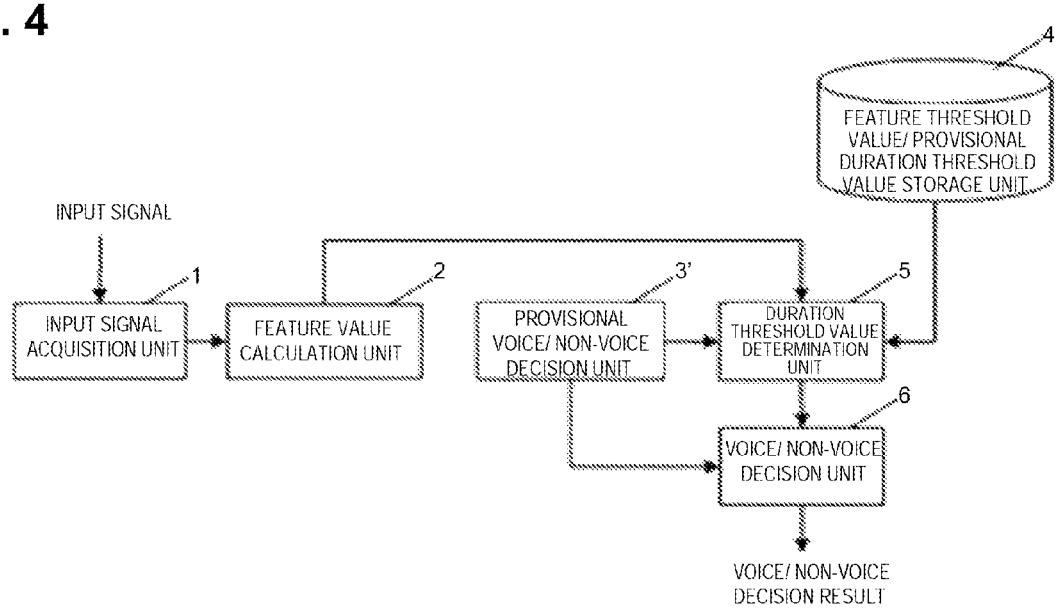
FIG. 4 is a block diagram showing a configuration of a fourth exemplary embodiment of the present invention.

A fourth exemplary embodiment of the present invention will now be described. FIG. 4 shows a configuration of the fourth exemplary embodiment of the present invention. In the fourth exemplary embodiment of the present invention, shown in FIG. 4, the provisional voice/non-voice decision unit 3 of the first exemplary embodiment of FIG. 1, distinguishing the provisional voice and non-voice based on the feature values, calculated on a per frame basis, is replaced by a provisional voice/non-voice decision unit 3'. This provisional voice/non-voice decision unit 3' decides on the provisional voice/non-voice without dependency on the feature values calculated on a per frame basis. That is, the provisional voice/non-voice decision unit 3 of the first exemplary embodiment inputs an output of the feature value calculation unit 2, that is, the feature value calculated on a per frame basis. In the present exemplary embodiment, an output of the feature value calculation unit 2 (feature values calculated on a per frame basis) is not delivered to the provisional voice/non-voice decision unit 3'.

The provisional voice/non-voice decision unit 3' distinguishes between the voiced interval and the non-voiced interval from each other,

- by determining the intervals in their entirety to be voiced interval,
- by determining the intervals in their entirety to be non-voiced interval, or
- in accordance with a value as determined by a random number.

In the present exemplary embodiment, even in case the decision result by the provisional voice/non-voice decision unit 3' is unreliable, more accurate voice/non-voice discrimination may be made by the voice/non-voice decision unit 6 that distinguishes the voice and the non-voice from each other using the determined duration threshold value. It is thus possible to reduce the volume of computation needed in the provisional voice/non-voice decision in comparison with the case of the first exemplary embodiment above.

Exemplary Embodiment 5

Figure 5:
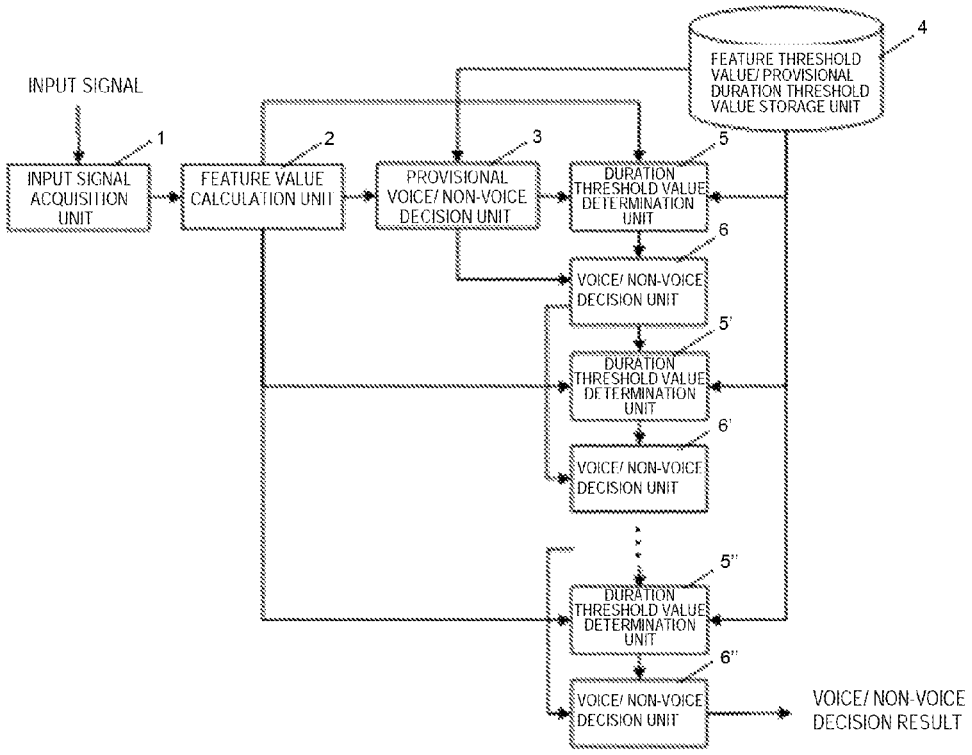
FIG. 5 is a block diagram showing a configuration of a fifth exemplary embodiment of the present invention.

A fifth exemplary embodiment of the present invention will now be described. FIG. 5 shows a configuration of the fifth exemplary embodiment of the present invention. Referring to FIG. 5, the present exemplary embodiment includes a plurality of duration threshold value determination units 5, 5', . . . , 5" and a plurality of voice/non-voice decision units 6, 6', . . . , 6", in addition to the component parts of the first exemplary embodiment shown in FIG. 1.

In a k'th stage duration threshold value determination unit, a duration threshold value found on k'th determination is calculated, using the frame-based feature value found by the feature value calculation unit 2 and the (k−1)st voice/non-voice decision result found by the (k−1)st stage voice/non-voice decision unit.

In the present exemplary embodiment, in which the voice/non-voice decision is carried out a plurality of numbers of times, the result of voice/non-voice decision may be more accurate than in the first exemplary embodiment described above.

Exemplary Embodiment 6

Figure 6:
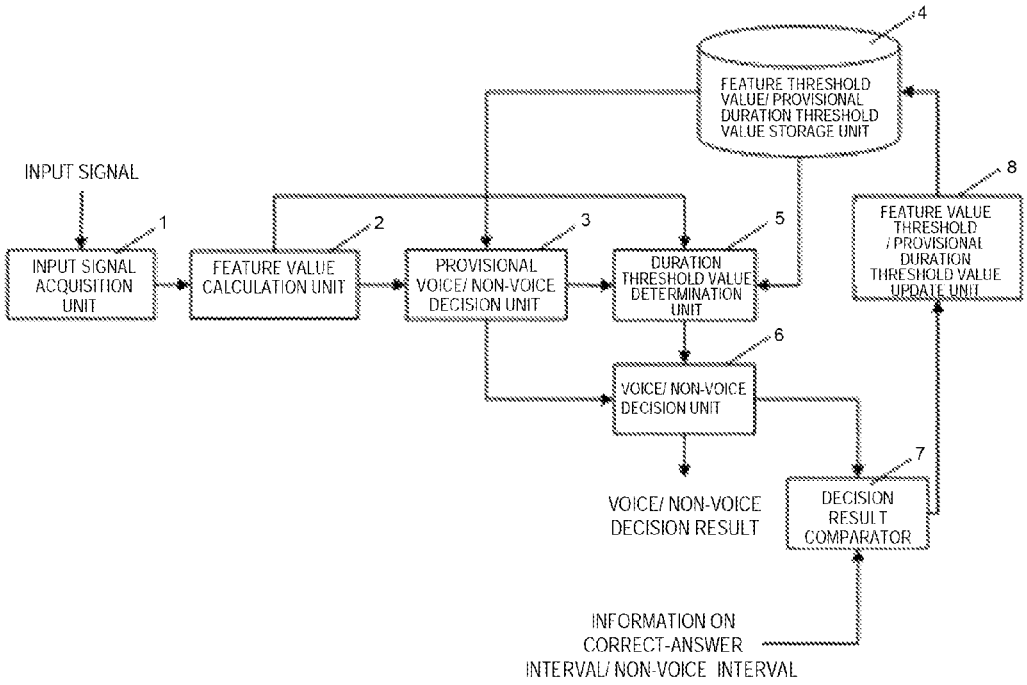
FIG. 6 is a block diagram showing a configuration of a sixth exemplary embodiment of the present invention.

A sixth exemplary embodiment of the present invention will now be described. FIG. 6 shows a configuration of the sixth exemplary embodiment of the present invention. The present exemplary embodiment determines and learns the threshold value for the feature value and the threshold value for interval shaping, such as duration threshold value. The threshold value may be determined beforehand as pre-processing for the first to fifth exemplary embodiments or at any time, such as at a timing of one-shot voice delay, during the prosecution of the first to fifth exemplary embodiments.

Referring to FIG. 6, the present exemplary embodiment includes, in addition to the component parts of the first exemplary embodiment above, a decision result comparator 7 and a feature threshold value/provisional duration threshold value update unit 8. The decision result comparator compares the result of voice/non-voice decision by the voice/non-voice decision unit 6 with a correct-answer voice/non-voice sequence (correct-answer voiced interval/non-voiced interval information). The feature threshold value/provisional duration threshold value update unit 8 determines the threshold value for the feature value and the duration threshold value based on the result of comparison by the decision result comparator 7.

As the correct-answer voice/non-voice result determined, voice data with known voice beginning time and known voice end time, a signal by a microphone ON/OFF button, or decision result by another voice detection apparatus of higher performance, may be used.

Figure 7:
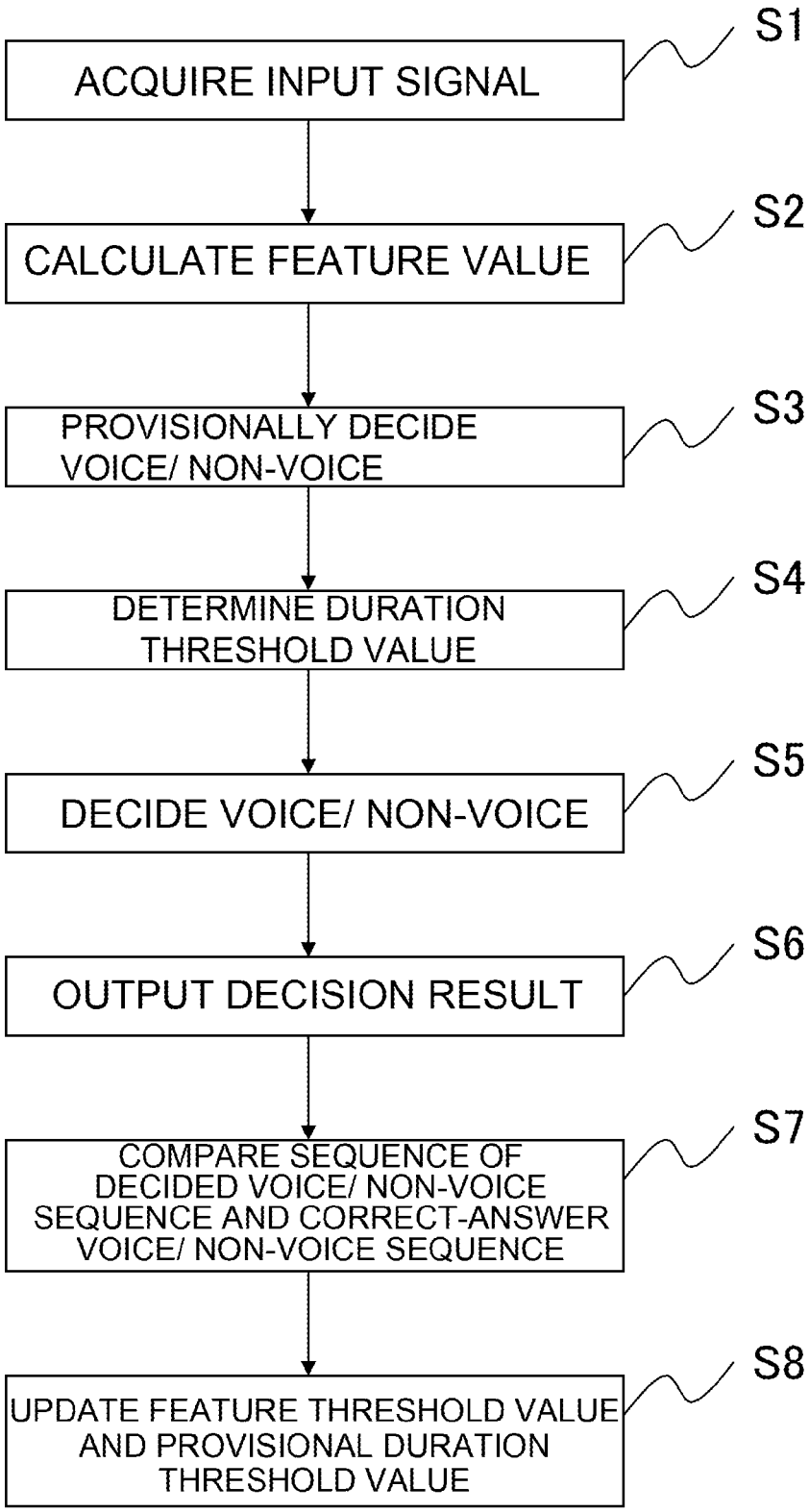
FIG. 7 is a flowchart for illustrating the processing sequence of the sixth exemplary embodiment of the present invention.

FIG. 7 is a flowchart that illustrates the global operation of the present exemplary embodiment. It is noted that steps S1 to S6 are the same as the corresponding steps of FIG. 2 and hence the description of the steps S1 to S6 is dispensed with.

In the present exemplary embodiment, the operation of the steps S1 to S6 is performed. Then, in the decision result comparator 7, the sequence of the voice/non-voice result determined by the voice/non-voice decision unit 6 is compared with the correct-answer voice/non-voice sequence (information on the correct-answer voiced interval/non-voiced interval) in step S7 of FIG. 7.

The decision result comparator 7 performs comparison on a plurality of frames (a T-number of frames) collected together. Each frame is e.g., a unit of utterance. A specified processing for comparison consists in calculating the difference of the number of correct-answer voiced frames, out of the above mentioned T-number of frames, and the number of frames decided to be voiced in the voice/non-voice decision unit 6. The difference in the number of the non-voiced frames may also be calculated in place of calculating the difference of the number of correct-answer voiced frames and the number of the non-voiced frames.

The feature threshold value/provisional duration threshold value update unit 8 then calculates, using the difference in the numbers of the voiced frames, the threshold value for the feature value calculated on a per frame basis, provisional voiced interval duration threshold value and the provisional non-voiced interval duration threshold value. For this determination, the following relationships (17) to (19) are used.

$$\theta^F \leftarrow \theta^F - \eta\frac{1}{T}\left(\begin{array}{c}\text{number of correct-answer voiced frames-}\\ \text{number of frames decided to be voiced}\end{array}\right) \quad (17)$$

$$\theta^V \leftarrow \theta^V - \eta\frac{1}{T}\left(\begin{array}{c}\text{number of correct-answer voiced frames-}\\ \text{number of frames decided to be voiced}\end{array}\right) \quad (18)$$

$$\theta^N \leftarrow \theta^N + \eta\frac{1}{T}\left(\begin{array}{c}\text{number of correct-answer voiced frames-}\\ \text{number of frames decided to be voiced}\end{array}\right) \quad (19)$$

In the relationships (17) to (19), $\theta^F$, $\theta^V$ and $\theta^V$ in the left sides represent an determined threshold value of the feature value, an determined voiced interval duration threshold value and an determined continuous non-voice duration threshold value, respectively.

In the right sides, $\theta^F$, $\theta^V$ and $\theta^V$ represent a threshold value of the provisional feature value, a threshold value of the voiced interval duration and a threshold value of a continuous non-voice length, respectively.

$\eta$ is a pre-set parameter that adjusts the speed of determination.

In place of the methods for determination, represented by the relationships (17) to (19), another method for determination that determines the threshold values so that the number of correct-answer voiced frames will be coincident with the number of frames decided to be voiced, or still another method for determination that determines the threshold value so that the number of correct-answer non-voiced frames will be coincident with the number of frames decided to be non-voiced, may also be used.

Finally, the threshold value and the shaping rule determined are reflected in the feature threshold value/provisional duration threshold value storage unit 4 (step S8 of FIG. 7).

In the present exemplary embodiment, the threshold values regarding the shaping rule, such as the provisional duration threshold value or the threshold value for the feature value, relevant to voice detection, may be set to proper values in accordance with the noise environment.

Exemplary Embodiment 7

Figure 8:
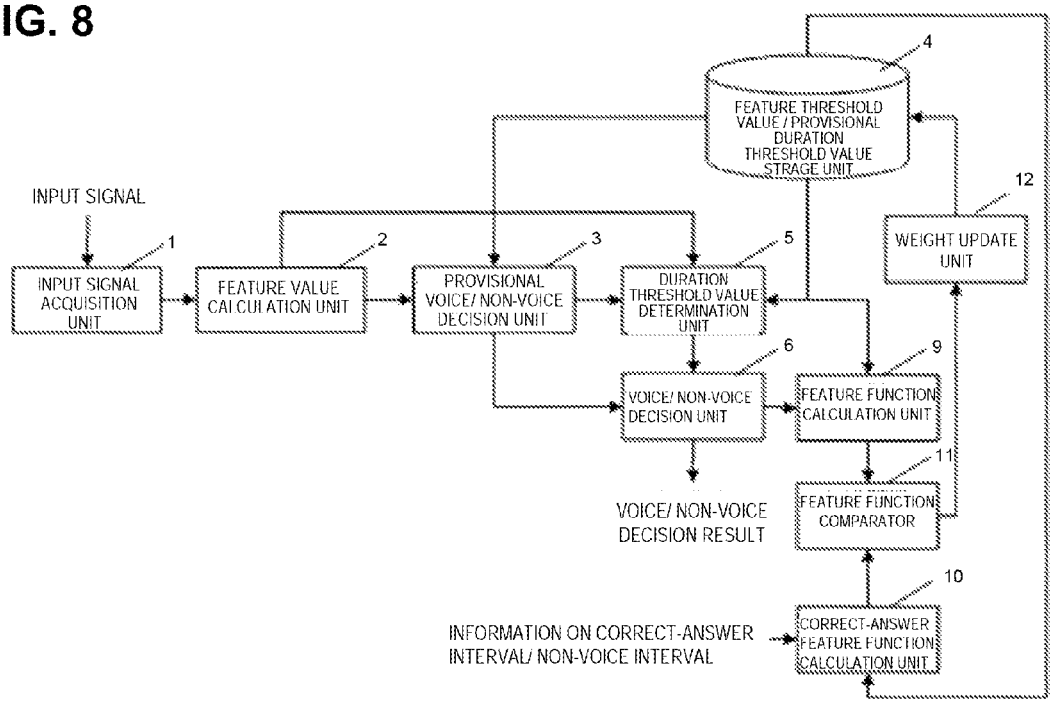
FIG. 8 is a block diagram showing a configuration of a seventh exemplary embodiment 7 of the present invention.

A seventh exemplary embodiment of the present invention will now be described. FIG. 8 shows a configuration of the seventh exemplary embodiment of the present invention. In the present exemplary embodiment, the weight for the threshold value for the feature value or the threshold value regarding the shaping rule, such as the duration threshold value, are determined and learned. The weights for the threshold values may be determined or learned beforehand as pre-processing for the exemplary embodiments 1 to 5 or at any time such at a timing of one-shot voice delay as incidentally during the prosecution of the exemplary embodiments 1 to 5.

Referring to FIG. 8, the present exemplary embodiment includes, in addition to the first exemplary embodiment above, a correct-answer feature function calculation unit 10 that calculates a feature function from a correct-answer voice/non-voice sequence, a feature function comparator 11 that compares a feature function calculated from the result of voice/non-voice decision with a correct-answer feature function calculated from the correct-answer voice/non-voice sequence, and a weight update unit 12 that determines the weight of each rule based on the comparison in the feature function comparator 11.

As the correct-answer voice/non-voice result determined, inputting of voice data with known voice beginning time and known voice end time, a signal by a microphone ON/OFF button, or decision result by another voice detection apparatus of higher performance, may be used.

Figure 9:
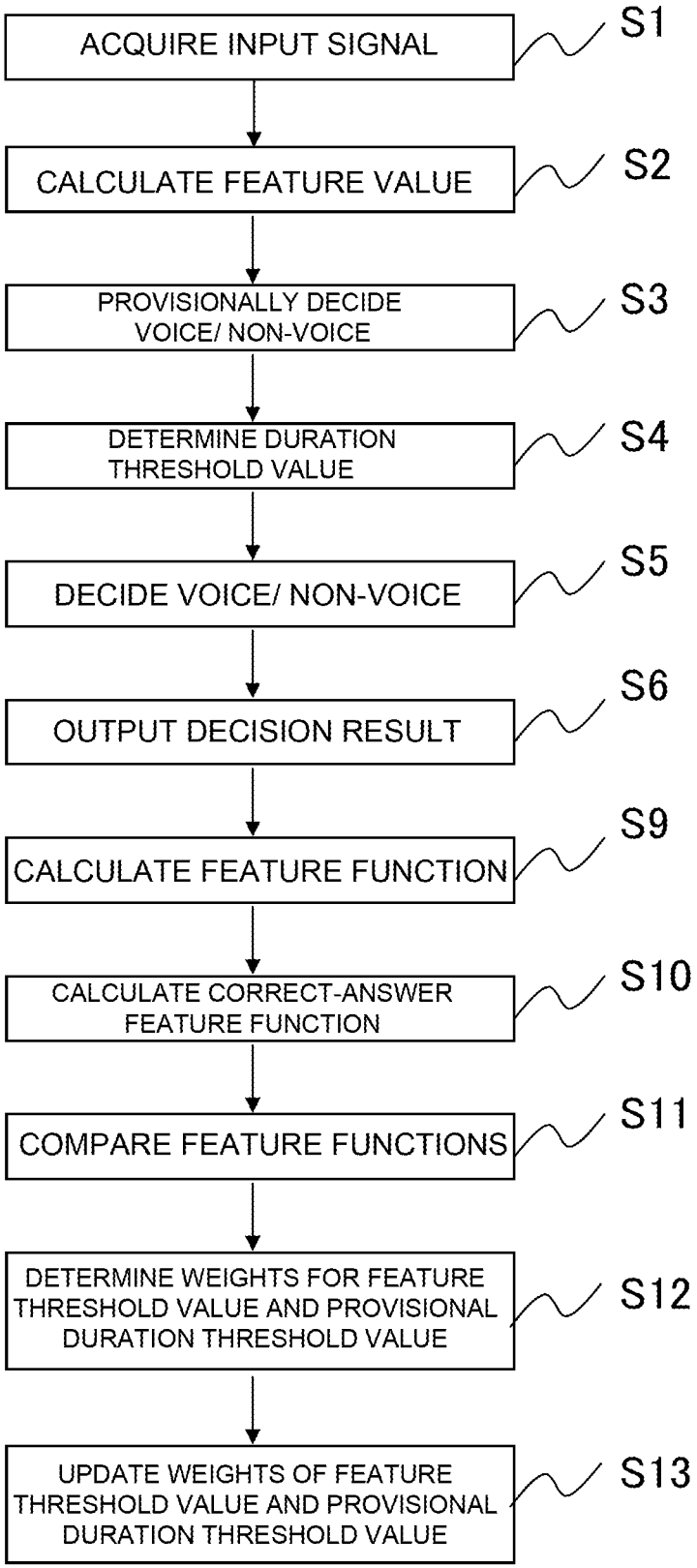
FIG. 9 is a flowchart for illustrating the processing sequence of the seventh exemplary embodiment of the present invention.
Figure 10:
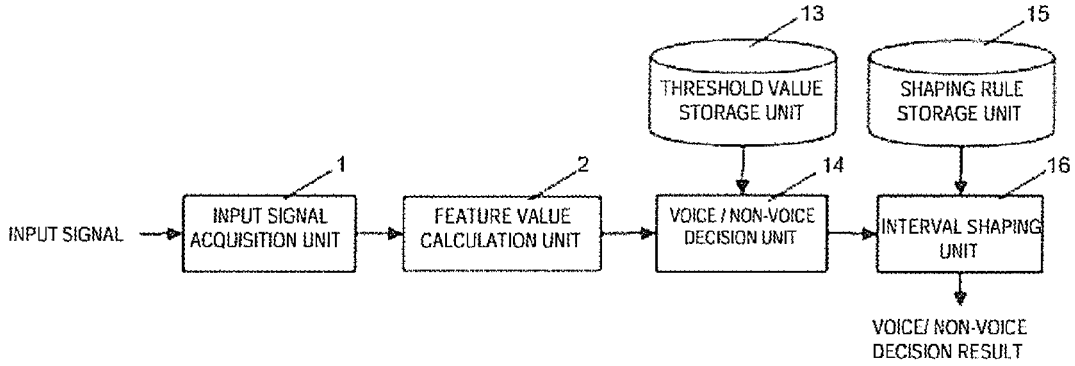
FIG. 10 RELATED ART
FIG. 10 is a block diagram showing an example of a configuration of a typical voice detection system according to the related art.

FIG. 9 is a flowchart that illustrates the global operation of the present exemplary embodiment. It is noted that steps S1 to S6 in FIG. 9 are the equivalent to the steps S1 to S6 of FIG. 2 and hence the description for these steps is dispensed with.

In the present exemplary embodiment, a log value of the ratio of a feature value, defined as a feature function on the basis of the maximum entropy method (MEM), and a threshold value for the feature value, is calculated for the voice/non-voiced interval determined. Or, a log value of the ratio of the duration to the duration threshold value is calculated for the voice/non-voiced interval determined. Either one of the log values is also calculated for the correct-answer voice/non-voice sequence. The log value of the ratio of the feature value to its threshold value, or the log value of the ratio of the duration to its threshold value, calculated for the determined voice/non-voiced interval, is compared with the corresponding the log value calculated for the correct-answer voice/non-voice sequence. The values of weights are determined so that the difference of the two will become smaller. As regards the maximum entropy method, reference is made to Non-Patent Document 5 (Kenji KITA, 'Stochastic Language Model', chapter 6, pages 155 to 262).

In the present exemplary embodiment, the operation of steps S1 to S6, explained in connection of the first exemplary embodiment above, is carried out.

The feature function calculation unit 9 then calculates a feature function from the result of the voice/non-voice decision, feature value, threshold value for the feature value, and from the threshold value of the feature value as well as the threshold value of the duration. The threshold value of the feature value as well as the threshold value of the duration is stored in the feature threshold value/provisional duration threshold value storage unit 4 (step S9 of FIG. 9).

For calculating the feature function, the following equations (20), (21) and (22) are used.

$$f_F(t) = \begin{cases} +\frac{1}{2}(F(t) - \theta_F) & \text{voiced interval} \\ -\frac{1}{2}(F(t) - \theta_F) & \text{non-voiced interval} \end{cases} \tag{20}$$

$$f_V(t) = \begin{cases} L_V(t) - \theta_V & \text{voiced interval} \\ 0 & \text{non-voiced interval} \end{cases} \tag{21}$$

$$f_N(t) = \begin{cases} 0 & \text{voiced interval} \\ L_N(t) - \theta_N & \text{non-voiced interval} \end{cases} \tag{22}$$

In the equation (20), (21) and (22), $f_F$, $f_V$ and $f_N$ in the left sides respectively denote a feature function of a feature value, a feature function of a voiced interval duration and a feature function of the non-voiced interval duration.

The correct-answer feature function calculation unit 10 then calculates a correct-answer function from the correct-answer/non-voice sequence, a feature value (feature value calculated by the feature value calculation unit 2), and from the threshold values for the feature value and for the duration. These threshold values for the feature value and for the duration are stored in the feature threshold value/provisional duration threshold value storage unit 4 (step S10 of FIG. 9).

In calculating the correct-answer function, the following equations (23) to (25) are used:

$$f_F^{Ans.}(t) = \begin{cases} +\frac{1}{2}(F(t) - \theta_F) & \text{correct-answer voiced interval} \\ -\frac{1}{2}(F(t) - \theta_F) & \text{correct-answer non-voiced interval} \end{cases} \tag{23}$$

$$f_V^{Ans.}(t) = \begin{cases} L_V^{Ans.}(t) - \theta_V & \text{correct-answer voiced interval} \\ 0 & \text{correct-answer non-voiced interval} \end{cases} \tag{24}$$

$$f_N^{Ans.}(t) = \begin{cases} 0 & \text{correct-answer voiced interval} \\ L_N^{Ans.} - \theta_N & \text{correct-answer non-voiced interval} \end{cases} \tag{25}$$

In the above equations (23) to (25), $f^{Ans}{}_F$, $f^{Ans}{}_V$ and $f^{Ans}{}_N$ respectively denote a feature function of a feature value, a feature function of a voiced interval duration and a feature function of a non-voiced interval duration. Also, in the equations (23) to (25), F(t) is a value determined for an input signal, whereas $L^{Ans.}{}_N(t)$ and $L^{Ans.}{}_N(t)$ are values determined for a correct-answer voice/non-voice determined interval.

The feature function comparator 11 then compares the feature function for the results of the voice/non-voice decision with the feature function for the correct-answer voice/non-voice sequence (step S11 of FIG. 9). The comparison is made for a T-number of frames of utterance units collected together.

For concrete processing for comparison, the difference of the feature function for the result of the above mentioned voice/non-voice decision and the feature function for the correct-answer voice/non-voice sequence, averaged over a T-number of frames, is used.

The weight update unit 12 then determines the weight for the threshold value for the feature value/provisional duration threshold value, using the difference of the feature functions.

To determine the weight, the equations (26) to (28), for example, are used.

$$\lambda^F \leftarrow \lambda^F + \eta\frac{1}{T}\left(\sum_{t=0}^{T-1} f_F^{Ans.}(t) - \sum_{t=0}^{T-1} f_F(t)\right) \tag{26}$$

$$\lambda^V \leftarrow \lambda^V + \eta\frac{1}{T}\left(\sum_{t=0}^{T-1} f_V^{Ans.}(t) - \sum_{t=0}^{T-1} f_V(t)\right) \tag{27}$$

$$\lambda^N \leftarrow \lambda^N + \eta\frac{1}{T}\left(\sum_{t=0}^{T-1} f_N^{Ans.}(t) - \sum_{t=0}^{T-1} f_N(t)\right) \tag{28}$$

In the equations (26) to (28), $\lambda^F$, $\lambda^V$ and $\lambda^N$ in the left sides respectively denote weights for the determined feature value, determined voiced interval duration and the determined non-voiced interval duration.

$\lambda^F$, $\lambda^V$ and $\lambda^N$ in the left sides denote a weight for the provisional feature value, a weight for the voiced interval duration and a weight for the non-voiced interval duration, respectively.

$\eta$ denotes a preset parameter that adjusts the speed of determination.

In the present exemplary embodiment, the method for determining the weight by the maximum entropy method (MEM) has been shown and described. However, any other suitable method for determining and learning the parameter may be used.

Finally, the determined weights are reflected in the feature threshold value/provisional duration threshold value storage unit 4 (step S13).

In the present exemplary embodiments, the parameter for the weight for the provisional duration threshold value and the threshold value for the feature value relating to voice detection may be set to proper values in accordance with the noise environment.

The above exemplary embodiments may also be combined together. These exemplary embodiments provide a voice detection apparatus that provides an optimum performance without dependency upon the noise environment.

The above exemplary embodiments may substantially be summarized, though not limited thereto, as follows:

[1] A voice detection apparatus according to an exemplary embodiment includes:

a means that provisionally decides an input signal to be voiced or non-voiced on a per frame basis;

a means that performs interval shaping of the voiced and non-voiced sequences of the provisional decision result, in accordance with a rule for a pre-defined number of frames, to find a voiced interval and a non-voiced interval of the input signal; and a means that variably controls, on a per frame basis, one or more parameters of the rule regarding the interval shaping, based on whether or not a feature value of the frame of the input signal can be regarded as being reliable.

[2] In the voice detection apparatus according to an exemplary embodiment in [1] above, the rule regarding the interval shaping includes at least one of:

a threshold value for a feature value of the input signal;

a voiced interval duration threshold value which is a threshold value of a duration of a voiced interval used for deciding whether or not a frame of interest is in a voiced interval; and a non-voiced interval duration threshold value which is a threshold value of a duration of a non-voiced interval used for deciding whether or not a frame of interest is in a non-voiced interval.

[3] A voice detection apparatus according to an exemplary embodiment comprises a provisional voice/non-voice decision unit that provisionally decides an input signal to be voiced or non-voiced on a per frame basis;

a voice/non-voice decision unit that performs interval shaping on the voiced and non-voiced sequences of the provisional decision result, based on at least one of a voiced interval duration threshold value, which is a threshold value of a voiced interval duration used for deciding whether or not a frame of interest is in a voiced interval; and a non-voiced interval duration threshold value, which is a threshold value of a non-voiced interval duration used for deciding whether or not a frame of interest is in a non-voiced interval to find the voiced interval and the non-voiced interval of the input signal; and a threshold duration determination unit that determines at least one of the threshold value for the voiced interval duration and the threshold value for the non-voiced interval duration, on a per frame basis, based on at least one of a provisional threshold value of a voiced interval duration and a provisional threshold value of a non-voiced interval duration;

at least one feature value of the input signal found for the frame of interest; and a threshold value for the feature value.

[4] In the voice detection apparatus according to an exemplary embodiment, in [2] or [3] above, the voiced interval duration threshold value is a duration of a necessary minimum voiced interval duration with which the frame of interest may be decided to be in a voiced interval; and the non-voiced interval duration threshold value is a duration of a necessary minimum non-voiced interval duration with which the frame of interest may be decided to be in a non-voiced interval.

[5] In the voice detection apparatus according to an exemplary embodiment, in any one of [3] or [4] above, the duration threshold value determination unit determines the voiced interval duration threshold value, based on a value obtained by multiplying a ratio of the feature value of the input signal of a given frame to a threshold value of the feature value, raised to the power of a ratio of a weighting coefficient determined for the provisional voiced interval duration threshold value to a weighting coefficient determined for the feature value, by the provisional voiced interval duration threshold value.

[6] In the voice detection apparatus according to an exemplary embodiment, in any one of [3] to [5] above, the duration threshold value determination unit determines the non-voiced interval duration threshold value based on a value obtained by multiplying a ratio of the threshold value of the feature value of the input signal of a given frame and the feature value, raised to the power of a ratio of a weighting coefficient determined for the provisional non-voiced interval duration threshold value and a weighting coefficient determined for the feature value, by the provisional non-voiced interval duration threshold value.

[7] In the voice detection apparatus according to an exemplary embodiment, in [3] or [4] above, the duration threshold value determination unit determines the voiced interval duration threshold value based on a value obtained by multiplying a difference of the threshold value of the feature value of the input signal of a given frame and the feature value with a ratio of a weighting coefficient determined for the provisional voiced interval duration threshold value and a weighting coefficient determined for the feature value and on adding the provisional voiced interval duration threshold value to a resulting value.

[8] In the voice detection apparatus according to an exemplary embodiment, in any one of [3], [4] and [7] above, the duration threshold value determination unit determines the non-voiced interval duration threshold value based on a value obtained by multiplying a difference of the feature value of the input signal of a given frame and the threshold value of the feature value with a ratio of a weighting coefficient determined for the provisional non-voiced interval duration threshold value to a weighting coefficient determined for the feature value, and adding the provisional non-voiced interval duration threshold value to the multiplication value

[9] In the voice detection apparatus according to an exemplary embodiment, in [3] or [4] above, the duration threshold value determination unit determines the voiced interval duration threshold value based on a value obtained by performing weighted multiplication of ratios of a plurality of feature values of the input signal found for the frame of interest to threshold values for the feature values, and multiplying the multiplication result with the provisional voiced interval duration threshold value, or a value obtained by performing weighted addition of differences between a plurality of feature values of the input signal found for the frame of interest and threshold values for the feature values, and adding the provisional voiced interval duration threshold value to the weighted addition result.

[10] In the voice detection apparatus according to an exemplary embodiment, in any one of [3], [4] and [9] above, the duration threshold value determination unit determines the non-voiced interval duration threshold value, based on a value obtained by performing weighted multiplication of ratios of threshold values of a plurality of feature values of the input signal found for the frame of interest to the feature values and multiplying the multiplication result with the provisional non-voiced interval duration threshold value, or a value obtained by performing weighted addition of differences between a plurality of feature values of the input signal to threshold values for the feature values and adding the provisional non-voiced interval duration threshold value to the weighted addition result.

[11] In the voice detection apparatus according to an exemplary embodiment, in [3] or [4] above, the duration threshold value determining unit determines the voiced interval duration threshold value in accordance with the provisional voiced interval duration threshold value, at least one feature value of the input signal found for the frame of interest, and a difference or a ratio of the threshold value of the feature value and the feature value, and further in accordance with a difference or a ratio of the duration of a non-voiced interval neighboring to the frame of interest in a voice/non-voice sequence of the provisional decision results and the provisional non-voiced interval duration threshold value.

[12] In the voice detection apparatus according to an exemplary embodiment, in any one of [3], [4] or [11] above, the duration threshold value determination unit determines the non-voiced interval duration threshold value in accordance with the provisional non-voiced interval duration threshold value, a difference or a ratio of at least one feature value of the input signal found for the frame of interest and the threshold value of the feature value, and in accordance with a difference or a ratio of the duration of a voiced interval neighboring to the frame of interest in the voice and non-voice sequences of the provisional decision result and the provisional voiced interval duration threshold value.

[13] In the voice detection apparatus according to an exemplary embodiment, in (11) above, the duration threshold value determination unit determines the voiced interval duration threshold value using a value obtained by adding or multiplying another value which is obtained by performing weighted multiplication or weighted addition of a difference or a ratio of a feature value found for a frame of interest and a threshold value for the feature value and a difference or a ratio of a duration of a non-voiced interval neighboring to the frame of interest in the voice and non-voice sequences of the provisional decision result and a provisional non-voiced interval duration threshold value, by a provisional voiced interval duration threshold value.

[14] In the voice detection apparatus according to an exemplary embodiment, in [12] above, the duration threshold value determination unit determines the non-voiced interval duration threshold value using a value obtained by adding or multiplying another value which is obtained by performing weighted multiplication or weighted addition of a difference or a ratio of a feature value found for a frame of interest and a threshold value for the feature value and a difference or a ratio of a duration of a voiced interval neighboring to the frame of interest in the voice and non-voice sequences of the provisional decision result and a provisional voiced interval duration threshold value, by a provisional non-voiced interval duration threshold value.

[15] In the voice detection apparatus according to an exemplary embodiment, in [3] to [14] above, a decision obtained after distinguishing the voiced interval and the non-voiced interval from each other by the voice/non-voice decision unit is taken to be a provisional decision, and the processing of determining the voiced interval and the non-voiced interval is repeated one or more times.

[16] In the voice detection apparatus according to an exemplary embodiment, in any one of [3] to [15] above, the provisional voice/non-voice decision unit performs provisional voice/non-voice decision based on the feature value.

[17] The voice detection apparatus according to an exemplary embodiment, in any one [3] to [16] above, further comprises a means that learns and updates at least one of a threshold value for the feature value, a threshold value for a voiced interval duration, and a threshold value for a non-voiced interval duration threshold value, using another more reliable information regarding the voiced interval/non-voiced interval for the input signal.

[18] The voice detection apparatus according to an exemplary embodiment, in any one of [3] to [16] above, further comprises a means that learns and updates at least one of weights for a plurality of threshold values for a shaping rule, inclusive of a weight for the threshold value for the feature value, a weight for the voiced interval duration threshold value, and a weight for the non-voiced interval duration threshold value, using another more reliable information regarding the voiced interval/non-voiced interval for the input signal.

[19] A method for voice detection according to an exemplary embodiment comprises:

a step of provisionally deciding an input signal to be the voiced or the non-voiced on a per frame basis;

a step of performing interval shaping of the voiced and non-voiced sequences of the provisional decision result, in accordance with a rule for a pre-defined number of frames, to find a voiced interval and a non-voiced interval of the input signal; and a step of varying, on a per frame basis a parameter of the rule regarding the interval shaping, depending on whether or not the feature value of the frame of the input signal can be regarded as being reliable.

[20] In the method for voice detection according to an exemplary embodiment in [19] above, the rule regarding the interval shaping includes at least one of a threshold value for the feature value of the input signal;

a voiced interval duration threshold value; the threshold value of the voiced interval being a threshold value of the duration of a voiced interval used for deciding whether or not a frame of interest is in a voiced interval; and a non-voiced interval duration threshold value; the threshold value of the non-voiced interval being a threshold value of the duration of a non-voiced interval used for deciding whether or not a frame of interest is in a non-voiced interval.

[21] A method for voice detection according to an exemplary embodiment comprises a step of provisionally deciding an input signal into voice or non-voice on a per frame basis;

a step of performing interval shaping on the voiced and non-voiced sequences of the provisional decision result, based on at least one of a voiced interval duration threshold value, which is a threshold value of a voiced interval duration used for deciding whether or not a frame of interest is in a voiced interval;

a non-voiced interval duration threshold value, which is a threshold value of a non-voiced interval duration used for deciding whether or not a frame of interest is in a non-voiced interval to find the voiced interval and the non-voiced interval of the input signal; and a step of determining at least one of the voiced interval duration threshold value and the non-voiced interval duration threshold value, on a per frame basis, based on at least one of a provisional threshold value of the voiced interval duration and a provisional threshold value of the non-voiced interval duration;

at least one feature value of the input signal found for the frame of interest; and a threshold value for the feature value.

[22] In the method for voice detection according to [20] or [21] above, the voiced interval duration threshold value is a duration of a necessary minimum voiced interval duration with which a frame of interest may be decided to be in a voiced interval; and wherein the non-voiced interval duration threshold value is a duration of a necessary minimum non-voiced interval duration with which a frame of interest may be decided to be in a non-voiced interval.

[23] In the method for voice detection according to [20] or [21] above, the voiced interval duration threshold value is determined based on a value obtained by multiplying a ratio of the feature value of the input signal of a given frame to a threshold value of the feature value, raised to the power of a ratio of a weighting coefficient determined for the provisional voiced interval duration threshold value to a weighting coefficient determined for the feature value, by the provisional voiced interval duration threshold value.

[24] In the method for voice detection according to any one of [21] to [23] above, the non-voiced interval duration threshold value is determined based on a value obtained by multiplying a ratio of the threshold value of the feature value of the input signal of a given frame to the feature value, raised to the power of a ratio of a weighting coefficient determined for the provisional non-voiced interval duration threshold value to a weighting coefficient determined for the feature value, by the provisional non-voiced interval duration threshold value.

[25] In the method for voice detection according to [21] or [22] above, the voiced interval duration threshold value is determined based on a value obtained by multiplying a difference of the threshold value of the feature value of the input signal of a given frame and the feature value with a ratio of a weighting coefficient determined for the provisional voiced interval duration threshold value and a weighting coefficient determined for the feature value and on adding the provisional voiced interval duration threshold value to a resulting value.

[26] In the method for voice detection according to [21], [22] or [25] above, the non-voiced interval duration threshold value is determined based on a value obtained by multiplying a difference of the feature value of the input signal of a given frame and the threshold value of the feature value with a ratio of a weighting coefficient determined for the provisional non-voiced interval duration threshold value and a weighting coefficient determined for the feature value and on adding the provisional non-voiced interval duration threshold value to a resulting value.

[27] In the method for voice detection according to an exemplary embodiment in [21] or [22] above, the voiced interval duration threshold value is determined based on a value obtained by performing weighted multiplication of ratios of a plurality of feature values of the input signal found for the frame of interest to threshold values for the feature values, and multiplying the multiplication result with the provisional voiced interval duration threshold value, or a value obtained by performing weighted addition of differences between a plurality of feature values of the input signal found for the frame of interest and threshold values for the feature values, and adding the provisional voiced interval duration threshold value to the weighted addition result.

[28] In the method for voice detection according to [21], [22] or [27] above, the non-voiced interval duration threshold value is determined based on a value obtained by performing weighted multiplication of ratios of threshold values of a plurality of feature values of the input signal found for the frame of interest to the feature values and multiplying the multiplication result with the provisional non-voiced interval duration threshold value, or a value obtained by performing weighted addition of differences between a plurality of feature values of the input signal to threshold values for the feature values and adding the provisional non-voiced interval duration threshold value to the weighted addition result.

[29] In the method for voice detection according to an exemplary embodiment [21] or [22] above, the voiced interval duration threshold value is determined in accordance with the provisional voiced interval duration threshold value, at least one feature value of the input signal found for the frame of interest, and a difference or a ratio of the threshold value of the feature value and the feature value, and further in accordance with a difference or a ratio of the duration of a non-voiced interval neighboring to the frame of interest in a voice/non-voice sequence of the provisional decision results and the provisional non-voiced interval duration threshold value.

[30] In the method for voice detection according to an exemplary embodiment in [21], [22] or [29] above, the non-voiced interval duration threshold value is determined in accordance with the provisional non-voiced interval duration threshold value, a difference or a ratio of at least one feature value of the input signal found for the frame of interest and the threshold value of the feature value, and in accordance with a difference or a ratio of the duration of a voiced interval neighboring to the frame of interest in the voice and non-voice sequences of the provisional decision result and the provisional voiced interval duration threshold value.

[31] In the method for voice detection according to an exemplary embodiment in [29] above, the voiced interval duration threshold value is determined using a value obtained by adding or multiplying another value which is obtained by performing weighted multiplication or weighted addition of a difference or a ratio of a feature value found for a frame of interest and a threshold value for the feature value and a difference or a ratio of a duration of a non-voiced interval neighboring to the frame of interest in the voice and non-voice sequences of the provisional decision result and a provisional non-voiced interval duration threshold value, by a provisional voiced interval duration threshold value.

[32] In the method for voice detection according to an exemplary embodiment in [30] above, the non-voiced interval duration threshold value is determined using a value obtained by adding or multiplying another value which is obtained by performing weighted multiplication or weighted addition of a difference or a ratio of a feature value found for a frame of interest and a threshold value for the feature value and a difference or a ratio of a duration of a voiced interval neighboring to the frame of interest in the voice and non-voice sequences of the provisional decision result and a provisional voiced interval duration threshold value, by a provisional non-voiced interval duration threshold value.

[33] In the method for voice detection according an exemplary embodiment in any one of (21) to (32) above, a decision obtained after distinguishing the voiced interval and the non-voiced interval from each other by the voice/non-voice decision unit is taken to be a provisional decision, and wherein the processing of deciding the voiced/non-voiced interval is repeated one or more times.

[34] In the method for voice detection according to an exemplary embodiment in any one of [21] to [33] above, the provisional voice/non-voice decision is performed based on the feature value.

[35] The method for voice detection according to an exemplary embodiment in any one of [21] to [34], further comprises learning and updating at least one of a plurality of threshold values for the shaping rule, inclusive of a threshold value for a feature value, a threshold value for a voiced interval duration, and a threshold value for a non-voiced interval duration, using another more reliable information regarding the voiced interval/non-voiced interval for the input signal.

[36] The method for voice detection according to an exemplary embodiment in any one of [21] to [34] above further comprises learning and updating at least one of weights for a plurality of threshold values for a shaping rule, inclusive of a weight for the threshold value for the feature value, a weight for the voiced interval duration threshold value, and a weight for the non-voiced interval duration threshold value, using another more reliable information regarding the voiced interval/non-voiced interval for the input signal.

[37] A program according to an exemplary embodiment causes a computer to execute:

a processing that provisionally decides an input signal to be the voiced or the non-voiced on a per frame basis;

a processing that finds a voiced interval and a non-voiced interval of the input signal by interval shaping of the voiced and non-voiced sequences of the provisional decision result, in accordance with a rule for a pre-defined number of frames; and the processing of varying, on a per frame basis a parameter of the rule regarding the interval shaping, depending on whether or not the feature value of the frame of the input signal can be regarded as being reliable.

[38] In the program according to an exemplary embodiment in [37] above, the rule regarding the interval shaping includes at least one of a threshold value for the feature value of the input signal;

a voiced interval duration threshold value; the threshold value of the voiced interval being a threshold value of the duration of a voiced interval used for deciding whether or not a frame of interest is in a voiced interval; and a non-voiced interval duration threshold value; the threshold value of the non-voiced interval being a threshold value of the duration of a non-voiced interval used for deciding whether or not a frame of interest is in a non-voiced interval.

[39] A program according to an exemplary embodiment causes a computer to execute:

a processing that provisionally decides an input signal into voice or non-voice on a per frame basis;

a voice/non-voice determining processing that performs interval shaping on the voiced and non-voiced sequences of the provisional decision result, based on at least one of a voiced interval duration threshold value, which is a voiced interval duration threshold value used for deciding whether or not a frame of interest is in a voiced interval; and a non-voiced interval duration threshold value, which is a non-voiced interval duration threshold value used for deciding whether or not a frame of interest is in a non-voiced interval to find the voiced interval and the non-voiced interval of the input signal; and a duration threshold value determining processing that determines, on a per frame basis at least one of the threshold value for the voiced interval duration and the threshold value for the non-voiced interval duration, based on at least one of a provisional threshold value of the voiced interval duration and a provisional threshold value of the non-voiced interval duration;

at least one feature value of the input signal found for the frame of interest; and a threshold value for the feature value.

[40] In the program according to an exemplary embodiment in [38] or [39] above, the voiced interval duration threshold value is a duration of a necessary minimum voiced interval duration with which a frame of interest may be decided to be in a voiced interval; and wherein the non-voiced interval duration threshold value is a duration of a necessary minimum non-voiced interval duration with which a frame of interest may be decided to be in a non-voiced interval.

[41] In the program according to an exemplary embodiment in [39] or [40] above, the duration threshold value determining processing determines the voiced interval duration threshold value based on a value obtained by multiplying a ratio of the feature value of the input signal of a given frame to a threshold value of the feature value, raised to the power of a ratio of a weighting coefficient determined for the provisional voiced interval duration threshold value to a weighting coefficient determined for the feature value, by the provisional voiced interval duration threshold value.

[42] In the program according to an exemplary embodiment in any one of [39] to [41] above, the duration threshold value determining processing determines the non-voiced interval duration threshold value based on a value obtained by multiplying a ratio of the threshold value of the feature value of the input signal of a given frame and the feature value, raised to the power of a ratio of a weighting coefficient determined for the provisional non-voiced interval duration threshold value and a weighting coefficient determined for the feature value, by the provisional non-voiced interval duration threshold value.

[43] In the program according to an exemplary embodiment in [39] or [40] above, the duration threshold value determining processing determines the voiced interval duration threshold value based on a value obtained by multiplying a difference of the threshold value of the feature value of the input signal of a given frame and the feature value with a ratio of a weighting coefficient determined for the provisional voiced interval duration threshold value to a weighting coefficient determined for the feature value, and adding the provisional voiced interval duration threshold value to the multiplication value.

[44] In the program according to an exemplary embodiment in [39], [40] or [43] above, the duration threshold value determining processing determines the non-voiced interval duration threshold value based on a value obtained by multiplying a difference of the feature value of the input signal of a given frame and the threshold value of the feature value with a ratio of a weighting coefficient determined for the provisional non-voiced interval duration threshold value to a weighting coefficient determined for the feature value, and adding the provisional non-voiced interval duration threshold value to the multiplication value.

[45] In the program according to an exemplary embodiment in [39] or [40] above, the duration threshold value determining processing determines the voiced interval duration threshold value based on a value obtained by performing weighted multiplication of ratios of a plurality of feature values of the input signal found for the frame of interest to threshold values for the feature values, and multiplying the multiplication result with the provisional voiced interval duration threshold value, or a value obtained by performing weighted addition of differences between a plurality of feature values of the input signal found for the frame of interest and threshold values for the feature values, and adding the provisional voiced interval duration threshold value to the weighted addition result.

[46] In the program according to an exemplary embodiment in [39], [40] or [45] above, the duration threshold value determining processing determines the on-voiced interval duration threshold value based on a value obtained by performing weighted multiplication of ratios of threshold values of a plurality of feature values of the input signal found for the frame of interest to the feature values and multiplying the multiplication result with the provisional non-voiced interval duration threshold value, or a value obtained by performing weighted addition of differences between a plurality of feature values of the input signal to threshold values for the feature values and adding the provisional non-voiced interval duration threshold value to the weighted addition result.

[47] In the program according to an exemplary embodiment in [39] or [40] above, the duration threshold value determining processing determines the voiced interval duration threshold value in accordance with the provisional voiced interval duration threshold value, at least one feature value of the input signal found for the frame of interest, and a difference or a ratio of the threshold value of the feature value and the feature value, and further in accordance with a difference or a ratio of the duration of a non-voiced interval neighboring to the frame of interest in a voice/non-voice sequence of the provisional decision results and the provisional non-voiced interval duration threshold value.

[48] In the program according to an exemplary embodiment, in [39], [40] or [47] above, the duration threshold value determining processing determines the non-voiced interval duration threshold value in accordance with the provisional non-voiced interval duration threshold value, a difference or a ratio of at least one feature value of the input signal found for the frame of interest and the threshold value of the feature value, and in accordance with a difference or a ratio of the duration of a voiced interval neighboring to the frame of interest in the voice and non-voice sequences of the provisional decision result and the provisional voiced interval duration threshold value.

[49] In the program according to an exemplary embodiment in [47] above, the duration threshold value determining processing determines the voiced interval duration threshold value using a value obtained by adding or multiplying another value which is obtained by performing weighted multiplication or weighted addition of a difference or a ratio of a feature value found for a frame of interest and a threshold value for the feature value and a difference or a ratio of a duration of a non-voiced interval neighboring to the frame of interest in the voice and non-voice sequences of the provisional decision result and a provisional non-voiced interval duration threshold value, by a provisional voiced interval duration threshold value.

[50] In the program according to an exemplary embodiment in [48] above, the duration threshold value determining processing determines the non-voiced interval duration threshold value using a value obtained by adding or multiplying another value which is obtained by performing weighted multiplication or weighted addition of a difference or a ratio of a feature value found for a frame of interest and a threshold value for the feature value and a difference or a ratio of a duration of a voiced interval neighboring to the frame of interest in the voice and non-voice sequences of the provisional decision result and a provisional voiced interval duration threshold value, by a provisional non-voiced interval duration threshold value.

[51] In the program according to an exemplary embodiment in any one of [39] to [50] above, decision obtained after distinguishing the voiced interval and the non-voiced interval from each other by the voice/non-voice decision unit is taken to be a provisional decision, and the program causes the computer to repeat the processing of determining the voiced interval and the non-voiced interval one or more times.

[52] In the program according to an exemplary embodiment in any one of [39] to [51] above, the program causes the computer to execute the provisional voice/non-voice decision based on the feature value.

[53] In the program according to an exemplary embodiment, in any one of [39] to [51] above, the program causes the computer to execute a processing that learns and updates at least one of a plurality of threshold values for the shaping rule, inclusive of a threshold value for a feature value, a threshold value for a voiced interval duration, and a threshold value for a non-voiced interval duration, using another more reliable information regarding the voiced interval/non-voiced interval for the input signal.

[54] In the program according to an exemplary embodiment in any one of [39] to [51] above, the program causes the computer to execute a processing that learns and updates at least one of weights for a plurality of threshold values for a shaping rule, inclusive of a weight for the threshold value for the feature value, a weight for the voiced interval duration threshold value, and a weight for the non-voiced interval duration threshold value, using another more reliable information regarding the voiced interval/non-voiced interval for the input signal.

Industrial Utilizability

The present invention is applicable to optional apparatus that detect the voice or the non-voice.

The particular exemplary embodiments or examples may be modified or adjusted within the gamut of the entire disclosure of the present invention, inclusive of claims, based on the fundamental technical concept of the invention. Further, variegated combinations or selections of the elements disclosed herein may be made within the framework of the claims. That is, the present invention may comprehend various modifications or corrections that may occur to those skilled in the art within the gamut of the entire disclosure of the present invention, inclusive of claim and the technical concept of the present invention.

What is claimed is:

1. A voice detection apparatus comprising:

a provisional voice/ non-voice decision unit that provisionally decides an input signal to be voiced or non-voiced on a per frame basis;

a voice/ non-voice decision unit that performs interval shaping on the voiced and non-voiced sequences of the provisional decision result, based on at least one of a voiced interval duration threshold value, which is a threshold value of a voiced interval duration used for deciding whether or not a frame of interest is in a voiced interval, and a non-voiced interval duration threshold value, which is a threshold value of a non-voiced interval duration used for deciding whether or not a frame of interest is in a non-voiced interval to find the voiced interval and the non-voiced interval of the input signal; and a threshold duration determination unit that determines at least one of the threshold value for the voiced interval duration and the threshold value for the non-voiced interval duration, on a per frame basis, based on at least one of a provisional threshold value of a voiced interval duration and a provisional threshold value of a non-voiced interval duration;

at least one feature value of the input signal found for the frame of interest; and a threshold value for the feature value, wherein the duration threshold value determination unit determines the voiced interval duration threshold value, based on a value obtained by multiplying a ratio of the feature value of the input signal of a given frame to a threshold value of the feature value, raised to the power of a ratio of a weighting coefficient determined for the provisional voiced interval duration threshold value to a weighting coefficient determined for the feature value, by the provisional voiced interval duration threshold value, or a value obtained by multiplying a difference of the threshold value of the feature value of the input signal of the given frame and the feature value with a ratio of a weighting coefficient determined for the provisional voiced interval duration threshold value to a weighting coefficient determined for the feature value, and adding the provisional voiced interval duration threshold value to the multiplication value.

2. The voice detection apparatus according to claim 1, wherein the duration threshold value determination unit determines the non-voiced interval duration threshold value based on a value obtained by multiplying a ratio of the threshold value of the feature value of the input signal of a given frame and the feature value, raised to the power of a ratio of a weighting coefficient determined for the provisional non-voiced interval duration threshold value and a weighting coefficient determined for the feature value, by the provisional non-voiced interval duration threshold value, or a value obtained by multiplying a difference of the feature value of the input signal of a given frame and the threshold value of the feature value with a ratio of a weighting coefficient determined for the provisional non-voiced interval duration threshold value to a weighting coefficient determined for the feature value, and adding the provisional non-voiced interval duration threshold value to the multiplication value.

3. The voice detection apparatus according to claim 1, wherein the duration threshold value determination unit determines the voiced interval duration threshold value based on a value obtained by performing weighted multiplication of ratios of a plurality of feature values of the input signal found for the frame of interest to threshold values for the feature values, and multiplying the multiplication result with the provisional voiced interval duration threshold value, or a value obtained by performing weighted addition of differences between a plurality of feature values of the input signal found for the frame of interest and threshold values for the feature values, and adding the provisional voiced interval duration threshold value to the weighted addition result.

4. The voice detection apparatus according to claim 1, wherein the duration threshold value determination unit determines the non-voiced interval duration threshold value, based on a value obtained by performing weighted multiplication of ratios of threshold values of a plurality of feature values of the input signal found for the frame of interest to the feature values and multiplying the multiplication result with the provisional non-voiced interval duration threshold value, or a value obtained by performing weighted addition of differences between a plurality of feature values of the input signal to threshold values for the feature values and adding the provisional non-voiced interval duration threshold value to the weighted addition result.

5. The voice detection apparatus according to claim 1, wherein the duration threshold value determining unit determines the voiced interval duration threshold value in accordance with the provisional voiced interval duration threshold value, at least one feature value of the input signal found for the frame of interest, and a difference or a ratio of the threshold value of the feature value and the feature value, and further in accordance with a difference or a ratio of the duration of a non-voiced interval neighboring to the frame of interest in a voice/ non-voice sequence of the provisional decision results and the provisional non-voiced interval duration threshold value.

6. The voice detection apparatus according to claim 1, wherein the duration threshold value determination unit determines the non-voiced interval duration threshold value in accordance with the provisional non-voiced interval duration threshold value, a difference or a ratio of at least one feature value of the input signal found for the frame of interest and the threshold value of the feature value, and in accordance with a difference or a ratio of the duration of a voiced interval neighboring to the frame of interest in the voice and non-voice sequences of the provisional decision result and the provisional voiced interval duration threshold value.

7. The voice detection apparatus according to claim 5, wherein the duration threshold value determination unit determines the voiced interval duration threshold value using a value obtained by adding or multiplying another value which is obtained by performing weighted multiplication or weighted addition of a difference or a ratio of a feature value found for a frame of interest and a threshold value for the feature value and a difference or a ratio of a duration of a non-voiced interval neighboring to the frame of interest in the voice and non-voice sequences of the provisional decision result and a provisional non-voiced interval duration threshold value, by a provisional voiced interval duration threshold value.

8. The voice detection apparatus according to claim 6, wherein the duration threshold value determination unit determines the non-voiced interval duration threshold value using a value obtained by adding or multiplying another value which is obtained by performing weighted multiplication or weighted addition of a difference or a ratio of a feature value found for a frame of interest and a threshold value for the feature value and a difference or a ratio of a duration of a voiced interval neighboring to the frame of interest in the voice and non-voice sequences of the provisional decision result and a provisional voiced interval duration threshold value, by a provisional non-voiced interval duration threshold value.

9. The voice detection apparatus according to claim 1, wherein a decision obtained after distinguishing the voiced interval and the non-voiced interval from each other by the voice/ non-voice decision unit is taken to be a provisional decision, and wherein the processing of deciding the voiced /non-voiced interval is repeated one or more times.

10. The voice detection apparatus according to claim 1, wherein the provisional voice/ non-voice decision unit performs provisional voice/ non-voice decision based on the feature value.

11. The voice detection apparatus according to claim 1, further comprising:

a unit that learns and updates at least one of a plurality of threshold values for a shaping rule, inclusive of a threshold value for the feature value, a voiced interval duration threshold value, and a non-voiced interval duration threshold value, using another more reliable information regarding the voiced interval/ non-voiced interval for the input signal.

12. The voice detection apparatus according to claim 1, further comprising:

a unit that learns and updates at least one of weights for a plurality of threshold values for a shaping rule, inclusive of a weight for the threshold value for the feature value, a weight for the voiced interval duration threshold value, and a weight for the non-voiced interval duration threshold value, using another more reliable information regarding the voiced interval/ non-voiced interval for the input signal.

13. A method for voice detection, comprising, using a computer to perform the processings of:

receiving an input signal;

provisionally deciding the input signal into voice or non-voice on a per frame basis;

performing interval shaping on the voiced and non-voiced sequences of the provisional decision result, based on at least one of a voiced interval duration threshold value, which is a threshold value of a voiced interval duration used for deciding whether or not a frame of interest is in a voiced interval; and a non-voiced interval duration threshold value, which is a threshold value of a non-voiced interval duration used for deciding whether or not a frame of interest is in a non-voiced interval to find the voiced interval and the non-voiced interval of the input signal; and determining at least one of the voiced interval duration threshold value and the non-voiced interval duration threshold value, on a per frame basis, based on at least one of a provisional threshold value of the voiced interval duration and a provisional threshold value of the non-voiced interval duration, at least one feature value of the input signal found for the frame of interest, and a threshold value for the feature value, the method comprising:

determining the voiced interval duration threshold value based on a value obtained by multiplying a ratio of the feature value of the input signal of a given frame to a threshold value of the feature value, raised to the power of a ratio of a weighting coefficient determined for the provisional voiced interval duration threshold value to a weighting coefficient determined for the feature value, by the provisional voiced interval duration threshold value, or a value obtained by multiplying a difference of the threshold value of the feature value of the input given frame and the feature value with a ratio of a weighting coefficient determined for the provisional voiced interval duration threshold value and a weighting coefficient determined for the feature value and adding the provisional voiced interval duration threshold value to the multiplication value.

14. The method according to claim 13, comprising determining the non-voiced interval duration threshold value based on a value obtained by multiplying a ratio of the threshold value of the feature value of the input signal of a given frame to the feature value, raised to the power of a ratio of a weighting coefficient determined for the provisional non-voiced interval duration threshold value to a weighting coefficient determined for the feature value, by the provisional non-voiced interval duration threshold value, or a value obtained by multiplying a difference of the feature value of the input signal of a given frame and the threshold value of the feature value with a ratio of a weighting coefficient determined for the provisional non-voiced interval duration threshold value and a weighting coefficient determined for the feature value and adding the provisional non-voiced interval duration threshold value to the multiplication value.

15. The method according to claim 13, comprising determining the voiced interval duration threshold value based on a value obtained by performing weighted multiplication of ratios of a plurality of feature values of the input signal found for the frame of interest to threshold values for the feature values, and multiplying the multiplication result with the provisional voiced interval duration threshold value, or a value obtained by performing weighted addition of differences between a plurality of feature values of the input signal found for the frame of interest and threshold values for the feature values, and adding the provisional voiced interval duration threshold value to the weighted addition result.

16. The method according to claim 13, comprising determining the non-voiced interval duration threshold value based on a value obtained by performing weighted multiplication of ratios of threshold values of a plurality of feature values of the input signal found for the frame of interest to the feature values and multiplying the multiplication result with the provisional non-voiced interval duration threshold value, or a value obtained by performing weighted addition of differences between a plurality of feature values of the input signal to threshold values for the feature values and adding the provisional non-voiced interval duration threshold value to the weighted addition result.

17. The method according to claim 13, comprising determining the voiced interval duration threshold value in accordance with the provisional voiced interval duration threshold value, at least one feature value of the input signal found for the frame of interest, and a difference or a ratio of the threshold value of the feature value and the feature value, and further in accordance with a difference or a ratio of the duration of a non-voiced interval neighboring to the frame of interest in a voice/non-voice sequence of the provisional decision results and the provisional non-voiced interval duration threshold value.

18. The method according to claim 13, comprising determining the non-voiced interval duration threshold value in accordance with the provisional non-voiced interval duration threshold value, a difference or a ratio of at least one feature value of the input signal found for the frame of interest and the threshold value of the feature value, and in accordance with a difference or a ratio of the duration of a voiced interval neighboring to the frame of interest in the voice and non-voice sequences of the provisional decision result and the provisional voiced interval duration threshold value.

19. The method according to claim 17, comprising determining the voiced interval duration threshold value using a value obtained by adding or multiplying another value which is obtained by performing weighted multiplication or weighted addition of a difference or a ratio of a feature value found for a frame of interest and a threshold value for the feature value and a difference or a ratio of a duration of a non-voiced interval neighboring to the frame of interest in the voice and non-voice sequences of the provisional decision result and a provisional non-voiced interval duration threshold value, by a provisional voiced interval duration threshold value.

20. The method according to claim 18, comprising determining the non-voiced interval duration threshold value using a value obtained by adding or multiplying another value which is obtained by performing weighted multiplication or weighted addition of a difference or a ratio of a feature value found for a frame of interest and a threshold value for the feature value and a difference or a ratio of a duration of a voiced interval neighboring to the frame of interest in the voice and non-voice sequences of the provisional decision result and a provisional voiced interval duration threshold value, by a provisional non-voiced interval duration threshold value.

21. The method according to claim 13, wherein a decision obtained after distinguishing the voiced interval and the non-voiced interval from each other by the voice/ non-voice decision unit is taken to be a provisional decision, and wherein the processing of deciding the voiced /non-voiced interval is repeated one or more times.

22. The method according to claim 13, comprising performing the provisional voice/ non-voice decision based on the feature value.

23. The method according to claim 13, further comprising:

learning and updating at least one of a threshold value for the feature value, a threshold value for a voiced interval duration, and a threshold value for a non-voiced interval duration, using another more reliable information regarding the voiced interval/ non-voiced interval for the input signal.

24. The method according to claim 13, further comprising:

learning and updating at least one of weights for a plurality of threshold values for a shaping rule, inclusive of a weight for the threshold value for the feature value, a weight for the voiced interval duration threshold value, and a weight for the non-voiced interval duration threshold value, using another more reliable information regarding the voiced interval/ non-voiced interval for the input signal.

25. A non-transitory computer-readable recording medium storing a program that causes a computer to execute:

a processing that provisionally decides an input signal into voice or non-voice on a per frame basis;

a voice/ non-voice determining processing that performs interval shaping on the voiced and non-voiced sequences of the provisional decision result, based on at least one of a voiced interval duration threshold value, which is a voiced interval duration threshold value used for deciding whether or not a frame of interest is in a voiced interval; and a non-voiced interval duration threshold value, which is a non-voiced interval duration threshold value used for deciding whether or not a frame of interest is in a non-voiced interval to find the voiced interval and the non-voiced interval of the input signal; and a duration threshold value determining processing that determines, on a per frame basis at least one of the threshold value for the voiced interval duration and the threshold value for the non-voiced interval duration, based on at least one of a provisional threshold value of the voiced interval duration and a provisional threshold value of the non-voiced interval duration;

at least one feature value of the input signal found for the frame of interest; and a threshold value for the feature value, wherein the duration threshold value determining processing determines the voiced interval duration threshold value based on a value obtained by multiplying a ratio of the feature value of the input signal of a given frame to a threshold value of the feature value raised to the power of a ratio of a weighting coefficient determined for the provisional voiced interval duration threshold value to a weighting coefficient determined for the feature value, by the provisional voiced interval duration threshold value, or a value obtained by multiplying a difference of the threshold value of the feature value of the input signal of a given frame and the feature value with a ratio of a weighting coefficient determined for the provisional voiced interval duration threshold value to a weighting coefficient determined for the feature value, and adding the provisional voiced interval duration threshold value to the multiplication value.

26. The non-transitory computer-readable recording medium storing the program according to claim 25, wherein the duration threshold value determining processing determines the non-voiced interval duration threshold value based on a value obtained by multiplying a ratio of the threshold value of the feature value of the input signal of a given frame and the feature value, raised to the power of a ratio of a weighting coefficient determined for the provisional non-voiced interval duration threshold value and a weighting coefficient determined for the feature value, by the provisional non-voiced interval duration threshold value, or a value obtained by multiplying a difference of the feature value of the input signal of a given frame and the threshold value of the feature value with a ratio of a weighting coefficient determined for the provisional non-voiced interval duration threshold value to a weighting coefficient determined for the feature value, and adding the provisional non-voiced interval duration threshold value to the multiplication value.

27. The non-transitory computer-readable recording medium storing the program according to claim 25, wherein the duration threshold value determining processing determines the voiced interval duration threshold value based on a value obtained by performing weighted multiplication of ratios of a plurality of feature values of the input signal found for the frame of interest to threshold values for the feature values, and multiplying the multiplication result with the provisional voiced interval duration threshold value, or a value obtained by performing weighted addition of differences between a plurality of feature values of the input signal found for the frame of interest and threshold values for the feature values, and adding the provisional voiced interval duration threshold value to the weighted addition result.

28. The non-transitory computer-readable recording medium storing the program according to claim 25, wherein the duration threshold value determining processing determines the non-voiced interval duration threshold value based on a value obtained by performing weighted multiplication of ratios of threshold values of a plurality of feature values of the input signal found for the frame of interest to the feature values and multiplying the multiplication result with the provisional non-voiced interval duration threshold value, or a value obtained by performing weighted addition of differences between a plurality of feature values of the input signal to threshold values for the feature values and adding the provisional non-voiced interval duration threshold value to the weighted addition result.

29. The non-transitory computer-readable recording medium storing the program according to claim 25, wherein the duration threshold value determining processing determines the voiced interval duration threshold value in accordance with the provisional voiced interval duration threshold value, at least one feature value of the input signal found for the frame of interest, and a difference or a ratio of the threshold value of the feature value and the feature value, and further in accordance with a difference or a ratio of the duration of a non-voiced interval neighboring to the frame of interest in a voice/non-voice sequence of the provisional decision results and the provisional non-voiced interval duration threshold value.

30. The non-transitory computer-readable recording medium storing the program according to claim 25, wherein the duration threshold value determining processing determines the non-voiced interval duration threshold value in accordance with the provisional non-voiced interval duration threshold value, a difference or a ratio of at least one feature value of the input signal found for the frame of interest and the threshold value of the feature value, and in accordance with a difference or a ratio of the duration of a voiced interval neighboring to the frame of interest in the voice and non-voice sequences of the provisional decision result and the provisional voiced interval duration threshold value.

31. The non-transitory computer-readable recording medium storing the program according to claim 29, wherein the duration threshold value determining processing determines the voiced interval duration threshold value using a value obtained by adding or multiplying another value which is obtained by performing weighted multiplication or weighted addition of a difference or a ratio of a feature value found for a frame of interest and a threshold value for the feature value and a difference or a ratio of a duration of a non-voiced interval neighboring to the frame of interest in the voice and non-voice sequences of the provisional decision result and a provisional non-voiced interval duration threshold value, by a provisional voiced interval duration threshold value.

32. The non-transitory computer-readable recording medium storing the program according to claim 30, wherein the duration threshold value determining processing determines the non-voiced interval duration threshold value using a value obtained by adding or multiplying another value which is obtained by performing weighted multiplication or weighted addition of a difference or a ratio of a feature value found for a frame of interest and a threshold value for the feature value and a difference or a ratio of a duration of a voiced interval neighboring to the frame of interest in the voice and non-voice sequences of the provisional decision result and a provisional voiced interval duration threshold value, by a provisional non-voiced interval duration threshold value.

33. The non-transitory computer-readable recording medium storing the program according to claim 25, wherein a decision obtained after distinguishing the voiced interval and the non-voiced interval from each other by the voice/non-voice decision unit is taken to be a provisional decision and wherein the program causes the computer to repeat the processing of determining the voiced interval and the non-voiced interval one or more times.

34. The non-transitory computer-readable recording medium storing the program according to claim 25, wherein the program causes a computer to execute the provisional voice/ non-voice decision based on the feature value.

35. The non-transitory computer-readable recording medium storing the program according to claim 25, wherein the program causes a computer to execute a processing that learns and updates at least one of a threshold value for the feature value, a threshold value for a voiced interval duration, and a threshold value for a non-voiced interval duration, using another more reliable information regarding the voiced interval/ non-voiced interval for the input signal.

36. The non-transitory computer-readable recording medium storing the program according to claim 25, wherein the program causes a computer to execute a processing that learns and updates at least one of weights for a plurality of threshold values for a shaping rule, inclusive of a weight for the threshold value for the feature value, a weight for the voiced interval duration threshold value, and a weight for the non-voiced interval duration threshold value, using another more reliable information regarding the voiced interval/non-voiced interval for the input signal.

* * * * *